US012042856B2

(12) United States Patent
Delsine et al.

(10) Patent No.: US 12,042,856 B2
(45) Date of Patent: Jul. 23, 2024

(54) ROBOTIZED LADLE TRANSPORTATION DEVICE SYSTEM WITH EMBEDDED MANIPULATOR

(71) Applicant: Vesuvius Group, S.A., Ghlin (BE)

(72) Inventors: Damien Delsine, Ghlin (BE); Jean-Luc Renard, Ghlin (BE)

(73) Assignee: Vesuvius Group, SA, Ghlin (BE)

( * ) Notice: Subject to any disclaimer, the term of this patent is extended or adjusted under 35 U.S.C. 154(b) by 18 days.

(21) Appl. No.: 17/915,653

(22) PCT Filed: Mar. 30, 2021

(86) PCT No.: PCT/EP2021/058376
§ 371 (c)(1),
(2) Date: Sep. 29, 2022

(87) PCT Pub. No.: WO2021/198305
PCT Pub. Date: Oct. 7, 2021

(65) Prior Publication Data

US 2023/0339017 A1 Oct. 26, 2023

(30) Foreign Application Priority Data

Mar. 31, 2020 (EP) ..... 20167446

(51) Int. Cl.
*B22D 41/13* (2006.01)
*B22D 41/38* (2006.01)
*B22D 41/46* (2006.01)

(52) U.S. Cl.
CPC ..... *B22D 41/13* (2013.01); *B22D 41/38* (2013.01); *B22D 41/465* (2013.01)

(58) Field of Classification Search
CPC ..... B22D 41/13; B22D 41/38; B22D 41/46; B22D 41/56; B22D 41/465; B22D 47/00
USPC ..... 222/590, 607, 591, 606, 594; 266/236; 164/418, 437
See application file for complete search history.

(56) References Cited

U.S. PATENT DOCUMENTS 3,717,331 A * 2/1973 Simons ..... B22D 41/13 266/236
4,131,220 A * 12/1978 Bode, Jr. ..... B22D 41/56 222/607
8,215,375 B2 * 7/2012 Ebner ..... B22D 11/111 266/50

(Continued)

FOREIGN PATENT DOCUMENTS

CN 108326275 B 2/2020
EP 2412457 A1 2/2012

OTHER PUBLICATIONS

International Search Report for PCT/EP2021/058376, dated Jun. 15, 2021.

*Primary Examiner* — Jessee R Roe
*Assistant Examiner* — Michael Aboagye
(74) *Attorney, Agent, or Firm* — MaxGoLaw PLLC

(57) ABSTRACT

A metal casting installation is provided that includes a robot configured for carrying out the operations of handing a new ladle shroud to a manipulator of the ladle located at the loading station, and coupling a driving device to the ladle slide gate each manipulator is fixed relative to the corresponding first or second ladle such as to move together with the corresponding first or second ladle between the loading station and the casting station.

13 Claims, 8 Drawing Sheets

(56) References Cited

U.S. PATENT DOCUMENTS

| | | | | |
|---|---|---|---|---|
| 8,498,740 | B2 * | 7/2013 | Truttmann | B22D 41/22<br>222/597 |
| 8,820,592 | B2 * | 9/2014 | Boisdequin | B22D 41/56<br>266/287 |
| 8,926,893 | B2 * | 1/2015 | Boisdequin | B22D 11/106<br>266/236 |
| 2006/0118268 | A1 | 6/2006 | Collura et al. | |
| 2008/0314938 | A1 | 12/2008 | Ebner et al. | |
| 2011/0227267 | A1 | 9/2011 | Delsine | |
| 2011/0278331 | A1 | 11/2011 | Boisdequin et al. | |
| 2023/0145288 | A1 * | 5/2023 | Delsine | B22D 41/38<br>164/438 |

* cited by examiner

ROBOTIZED LADLE TRANSPORTATION DEVICE SYSTEM WITH EMBEDDED MANIPULATOR

FIELD OF THE INVENTION

The present invention relates to a robotized loading station for preparing a fresh ladle loaded on a rotating turret before being brought to a casting station over a tundish. In particular, the present invention concerns a robotized installation for loading a ladle shroud to a ladle sliding gate coupled to an outlet of the ladle, and for coupling a driving device to both ladle and ladle sliding gate for actuating the ladle sliding gate. The robotized loading station is also configured for de-coupling the driving device and unloading a spent ladle shroud off an emptied ladle recently removed from the casting station over the tundish. The robotization of these operations saves the operators from a strenuous task and enhances reproducibility of the operations. A specific manipulator embedded with a corresponding ladle and ladle sliding gate allows a swift unclogging of the outlet, should the latter become clogged.

BACKGROUND OF THE INVENTION

In continuous metal forming processes, metal melt (2) is transferred from one metallurgical vessel to another, to a mould or to a tool. For example, as shown in FIG. 1 a ladle (11, 12) is filled with metal melt out of a furnace (not shown) and transferred over a tundish (1) to discharge the molten metal from the ladle through a ladle shroud (13*a*-13*c*) into the tundish. The metal melt can then be cast through a pouring nozzle (3) from the tundish to a mould or tool for continuously forming slabs, billets, beams, thin slabs, and the like. Flow of metal melt out of the ladle into the tundish and out of the tundish into the mould or tool is driven by gravity. The flow rates can be controlled by sliding gates in fluid communication with an outlet of the ladle and tundish. A ladle sliding gate (15) can be used to control the flow rate off the ladle and even interrupt the flow at a sealed position. Similarly, a tundish sliding gate (5) can be used to control the flow rate off the tundish and interrupt the flow in a sealed position.

Since casting of metal into a mould or tool is to run continuously, the tundish plays the role of a buffer and the level of molten metal in the tundish must remain substantially constant during the whole casting operation. Maintaining the level of molten metal in the tundish substantially constant requires a rapid swap of a new ladle filled with molten metal with an old ladle after it has been emptied, to ensure a quasi-continuous feed of molten metal to the tundish, such that metal is poured into the tundish at substantially the same rate as it flows out thereof into the mould or the tool. This operation is rendered more complex by the following constraints.

First, since for safety reasons and to avoid any collision, a ladle (11,12) cannot be carried over a workshop from the furnace to a corresponding tundish with a ladle shroud (13*a*-13*c*) coupled to a bottom floor of the ladle and extending 1 m or more below the bottom floor, the ladle shroud must be coupled to the bottom floor of the ladle at a loading station located close to the tundish.

Second, to prevent metal contained in the second ladle (12) from freezing in contact with 'cold' moving parts of the ladle sliding gate (15) maintained in sealed position thus avoiding gripping the mechanism and preventing the opening of the ladle sliding gate, the inner bore of the inner nozzle is generally filled with a plugging material (19), usually sand or other particulate materials, to prevent any metal melt from reaching the gate mechanism, such that metal freezing and clogging of the nozzle and gate system are prevented. Upon opening the ladle sliding gate to a casting position with the ladle located at the casting station, the sand flows out followed by molten metal which can flow through the ladle shroud into the tundish. Sometimes, however, the plugging material is locally bound with frozen metal forming a solid plug preventing the plugging material from flowing out. The inner nozzle is therefore clogged, and no metal can flow out of the ladle into the tundish in spite of the ladle sliding gate being in the casting position. This problem can easily be solved with an unclogging tool (19*r*) inserted into or close to the bore of the inner nozzle. The unclogging tool (19*r*) can be a pressurized gas lance or an elongated rod, as illustrated in FIG. 2(*c*). Now, this apparently simple operation is actually quite complex because of the long ladle shroud (13*a*-13*c*) which is coupled to the ladle sliding gate.

For these reasons, in most installations, the ladle shroud is not coupled to the sliding gate in an autonomous way at the loading station, but it is inserted over a collector nozzle and held in place by a robot located at the casting station instead. This allows the ladle shroud to be removed from the collector nozzle by the robot in case of clogging of the ladle outlet, for easier access thereto from the bottom with an unclogging tool (19*r*). Once the clogged passage is unclogged, the ladle sliding gate can move into the sealing position while the robot reintroduces the ladle shroud over the collector nozzle. At this point the ladle sliding gate moves back into the casting position to start casting molten metal into the tundish. A robot is, however, not always available, or cannot even be positioned on the casting platform at the casting station, which can be rather small and crowded. In such conditions, this solution of holding the ladle shroud during the casting operation becomes problematic.

A newly filled ladle is transported from the furnace to a casing installation with a ladle sliding gate fixed to a bottom floor of the ladle, but without a driving device to actuate the relative movements of the plates forming the ladle sliding gate. For this reason, many metallurgic installations use a turret (30) comprising a first holding device for holding a first ladle (11) at a casting station over the tundish (1) and a second holding device for holding a second ladle (12) full of molten metal at a loading station. While the first ladle discharges the molten metal contained therein into the tundish, the second ladle can be prepared for performing the same operation once the first ladle is emptied. In particular, a driving device, such as a hydraulic piston can be coupled to the bottom floor of the ladle and to the ladle sliding gate, to allow actuation thereof.

US2006/0118268 describes a ladle sliding gate configured for autonomously holding a ladle shroud as well as a collector nozzle, set side by side. One or more driving devices, such as hydraulic pistons, can be used to actuate the ladle sliding gate by moving plates thereof between a sealed position wherein the opening is sealed, a casting position wherein the opening is in fluid communication with the ladle shroud, and an unclogging position wherein the opening is in fluid communication with the collector nozzle. This way, in case of clogging of the inner bore, the ladle sliding gate moves to the unclogging position, so that the unclogging tool (19*r*) can easily be introduced through the short collector nozzle bore to break the solidified metal bonded plugging material. Once the plugging material can flow again, the ladle sliding gate moves the collector nozzle out of registry from the ladle outlet and brings the ladle shroud into casting position to allow molten metal to flow through the ladle shroud into the tundish. Handling of the unclogging tool (19*r*) can advantageously be performed by a robot located adjacent to the casting station. A clear advantage over the holding of the ladle shroud by a robot described above, is that with this ladle sliding gate, no robot is required to hold the ladle shroud and a robot can be used instead to operate the unclogging tool (19*r*). Else, this operation must be performed manually by a human operator or a second robot must be installed adjacent to the casting station to unclog the inner bore. Manual handling is generally more laborious and takes longer time than when a robot performs this operation. This is disadvantageous because the longer time the tundish is not fed with fresh molten metal by the ladle, the lower is the level of molten metal in the tundish, and/or the longer is the time the casting operation must be run at lower flow rate which is disruptive of the quality of the beam thus produced.

US2008/0314938 describes a continuous casting plant having at least one multifunction robot for implementing a plurality of different process-controlled or automated interventions at the continuous casting plant. The multifunction robot arranged on a pivotable arm at a rotary column fastened to the pouring platform of the continuous casting plant and the robot can be pivoted with the pivot arm between a retraction position and a working position. The robot is also movable with respect to its arm.

The operation of swift swapping an emptied first ladle with a filled second ladle at the casting station remains a delicate operation. This operation is rendered even more critical in case of clogging of the inner bore, which can increase the time during which the tundish is not replenished with fresh molten metal. A need for a reproducible and shorter ladle swapping operation is sought in the metal casting industry. The present invention proposes a metal casting installation with fully automated ladle changing operations, including in case of clogging of the outlet of a ladle by frozen plugging material (19) allowing a reproducible and in all cases shorter swapping operation. These and other advantages of the present invention are explained more in detail in the following sections.

SUMMARY OF THE INVENTION

The objectives of the present invention have been reached with a metal casting installation comprising, (a) a loading platform, (b) a tundish, (c) a first ladle and a second ladle, each of the first and second ladle comprising, a floor provided with an opening, a ladle shroud, a ladle sliding gate comprising a collector nozzle configured for reversibly receiving and supporting the ladle shroud, the ladle sliding gate being further configured for being coupled to a driving device for actuating the ladle sliding gate between a sealed position wherein the opening is sealed and a casting position wherein the opening is in fluid communication with the ladle shroud, (d) a first and second ladle shroud manipulators for holding the ladle shroud coupled over the collector nozzle of the first and second ladles, respectively, (e) a transportation device including a turret or a ladle car, the transportation device comprising at least a first holding device and a second holding device for holding the first ladle and the second ladle, respectively, wherein the transportation device is configured for moving and holding in place the first and second ladles between a loading station, adjacent to the loading platform, and a casting station, over the tundish, wherein, the metal casting installation comprises a robot configured for carrying out the following operations on the first or second ladle which is held in the loading station, handling a new ladle shroud to the manipulator of the ladle located at the loading station, and coupling a driving device to the ladle slide gate, each manipulator is fixed relative to the corresponding first or second ladle, such as to move together with the corresponding first or second ladle between the loading station and the casting station.

The loading platform can comprise a tool storage rack containing one or more spare ladle shrouds within reaching distance of the robot, and preferably comprising one or more driving devices and/or spare parts such as spare collector nozzles, and tools. The robot can be movingly mounted on the loading platform such that the robot can translate parallel to a first axis (X) and/or second axis (Y) normal to the first axis (X), or combination thereof, and/or rotate about a vertical axis (Z) normal to the first and second axes (X, Y). It is preferred that the robot can thus reach and retrieve any tool or component from the storage rack and reach the ladle sliding gate of the first or second ladle which is held at the loading station for carrying out the operations defined supra.

The robot is preferably configured for collecting from the manipulator of the emptied first or second ladle which is held at the loading station after being moved from the casting station, the ladle shroud, and for removing the driving device.

The ladle sliding gate can comprise, (a) an upper plate comprising, a fixing surface and a bottom sliding surface separated from one another by a thickness of the upper plate, an upper bore extending from the fixing surface to the bottom sliding surface, and wherein the fixing surface of the upper plate is rigidly fixed to a lower portion of the corresponding first or second ladle with the upper bore in fluid communication with the opening, (b) A lower plate comprising, a nozzle surface and a top sliding surface separated from one another by a thickness of the lower plate, a lower bore extending from the top sliding surface to the nozzle surface, wherein the lower plate being slidingly mounted such that the top sliding extending from the top sliding surface to the nozzle surface, surface can slide in translation along the bottom sliding surface to bring the lower bore in and out of fluid communication with the upper bore, and wherein (c) the collector nozzle comprising a collector bore and being fixed to the nozzle surface of the lower plate with the collector nozzle in fluid communication with the lower bore.

(d) the driving device being coupled to the lower plate and comprising a cylinder rigidly and reversibly coupled to the bottom portion of the corresponding first or second ladle, and a piston rigidly and reversibly fixed to the lower plate, the driving device being configured for moving the lower plate to bring the lower bore in and out of registry with the upper bore.

In a first embodiment, the lower plate comprises a single lower bore, with a single collector nozzle fixed to the nozzle surface thereof.

In a second embodiment, the lower plate comprises a second lower bore separate from the lower bore and extending from the top sliding surface to the nozzle surface, and a second collector nozzle comprising a second collector bore is fixed to the nozzle surface of the lower plate with the second collector bore in fluid communication with the second lower bore.

Each of the first and second manipulators can be fixed either, to the corresponding first and second holding devices, or to the ladle sliding gate of the corresponding first and second ladle, such as to move together with the lower plate, or to the corresponding first and second ladles.

It is preferred that each of the first and second manipulators, can translate along a first direction parallel to the upper bore, can rotate about the first direction, comprises one or more arm segments extending substantially normal to a column parallel to the first direction, the one or more arm segments being coupled to the column and to one another by rotating joints configured for rotating about the first direction, comprises clamping means at a free end of the arm segment most remote from the column, for firmly and reversibly holding a ladle shroud.

The driving device can be actuated hydraulically or pneumatically or electrically. It is preferred that each of the first holding device and second holding device of the transportation device is provided with, a source of pressurized fluid for activating the driving device via a hose, or a source of electric power, and preferably a storing station for storing a driving device ready for coupling to a ladle sliding gate.

The metal casting installation can comprise a pre-heating oven for bringing and maintaining at a pre-heating temperature the new ladle shroud loaded on the ladle sliding gate of the first or second ladle located at the loading station.

In a preferred embodiment, the robot can also be configured, for checking a state of a spent ladle shroud after removal from an emptied ladle, for assessing whether the spent ladle shroud can be re-used after cleaning or whether it must be disposed of, and for cleaning the spent ladle shroud, with an oxygen shower, to remove any residue clinging to walls of the spent ladle shroud.

The present invention also concerns a method for casting a molten metal comprising the following steps, (a) providing a metal casting installation as described supra, wherein, the first ladle is full of molten metal and is in the casting station and the second ladle is full of molten metal and is in the loading station, the ladle sliding gate of the first ladle is in the sealed position, is coupled to one or more driving devices, and is provided with a ladle shroud held over a collector nozzle by the corresponding manipulator, the ladle sliding gate of the second ladle is in the sealed position and comprises a collector nozzle fixed to the lower plate, and comprises no ladle shroud and no operational driving device, (b) bringing the ladle sliding gate of the first ladle into casting position for casting molten metal from the first ladle through the ladle shroud into the tundish, (c) during the preceding step, handling with the robot a new ladle shroud to the second manipulator of the second ladle, coupling and holding in place with the second manipulator the new ladle shroud over the collector nozzle, coupling with the robot, the driving device to the sliding plate gate of the second ladle, (d) When the first ladle is substantially empty, bringing the ladle sliding gate of the first ladle into sealed position, followed by (e) swapping positions of the first and second ladles by moving the first ladle from the casting station to the loading station and, concomitantly, moving the second ladle from the loading station to the casting station, (f) bringing the ladle sliding gate of the second ladle into casting position and casting molten metal from the second ladle through the ladle shroud into the tundish.

During step (f), the method preferably comprises the following steps, (g) withdrawing with the first manipulator (35) the spent ladle shroud from the collector nozzle, (h) collecting with the robot the spent ladle shroud from the first manipulator and storing the spent ladle shroud for refurbishing or as waste, and (i) de-coupling and removing with the robot the one or more driving devices (17) from the sliding plate gate of the first ladle, and storing them for further use, (j) removing the emptied first ladle, and (k) loading a new ladle full of molten metal onto the first holding device of the transportation device at the loading station wherein, like the second ladle in step (a), the new ladle comprises a ladle sliding gate in the sealed position with a collector nozzle fixed thereto and comprising no ladle shroud.

In case the opening of the first ladle is filled with a plugging material and in case no molten metal flows out of the opening upon bringing the ladle sliding gate of the first ladle into casting station in step (b), unclogging the opening can be carried out in different ways.

In a first method, the following steps can be carried out, withdrawing with the first manipulator the ladle shroud from the collector nozzle to expose the collector nozzle, with an appropriate unclogging tool, unclogging the opening of the first ladle by disrupting the plugging material through the collector nozzle thus exposed, when the plugging material starts flowing out of the collector nozzle, coupling and holding in place with the first manipulator the ladle shroud over the collector nozzle, and thus allow molten metal to flow from the first ladle through the thus unplugged opening and through the ladle shroud into the tundish.

In a second method, wherein the lower plate comprises first and second lower bores and first and second collector nozzles, as described with respect to the second embodiment supra, the following steps can be carried out, translating the lower plate with the driving device into an unclogging position wherein the second lower bore is in registry with the upper bore, with an appropriate unclogging tool, unclogging the opening of the first ladle by disrupting the plugging material through the second collector nozzle thus exposed, when the plugging material starts flowing out of the collector nozzle, translating the lower plate with the driving device back into the casting position wherein the first lower bore is in registry with the upper bore and thus allow molten metal to flow from the first ladle through the thus unplugged opening and through the ladle shroud into the tundish.

The transportation device can be a turret. Step (e) of swapping positions of the first and second ladles can thus comprise the following steps, lifting the first and second ladles until the ladle shrouds of the first and second ladles are both clear off and higher than the tundish in a vertical direction (Z), rotating the turret about the vertical axis (Z) by 180° to bring the first ladle above the loading station, and to bring the second ladle above the casting station and above the tundish, lowering the first and second ladles to their respective loading and casting stations, the ladle shroud of the second ladle being inserted in the tundish, wherein during all the foregoing steps, the first and second manipulators (35) move together with the corresponding first and second ladles, while holding the corresponding ladle shrouds over the corresponding collector nozzles.

In a further embodiment, the robot also, checks a state of a spent ladle shroud after removal from an emptied ladle, assesses whether the spent ladle shroud can be re-used after cleaning or whether it must be disposed of, and cleans the spent ladle shroud, with an oxygen shower, to remove any residue clinging to walls of the spent ladle shroud.

BRIEF DESCRIPTION OF THE FIGURES

On these figures.

DETAILED DESCRIPTION

Figure 1A:
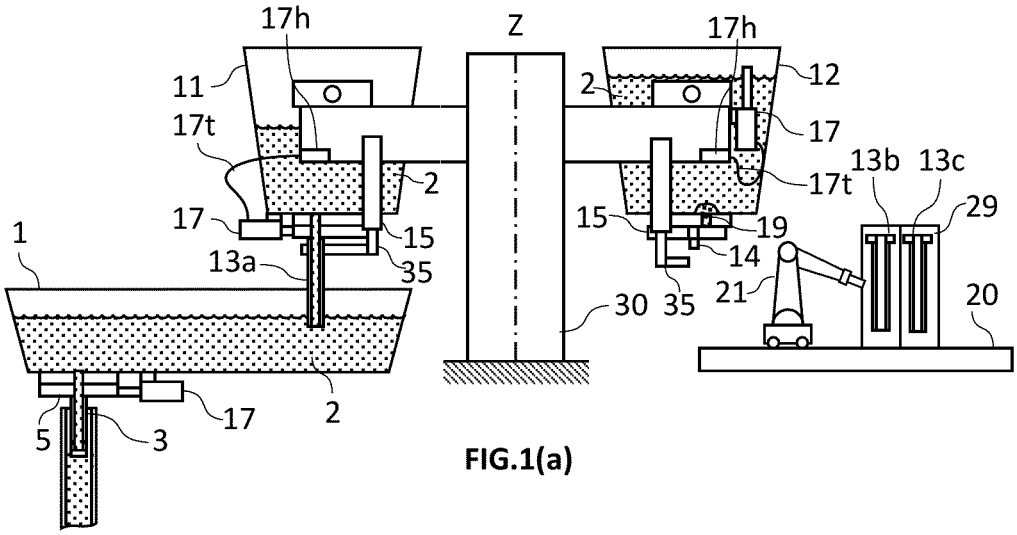
FIG. 1 depicts various steps of a swap of an emptied first ladle away from the casting station and replacement thereof by a full second ladle after preparation thereof at the loading station.
Figure 1B:
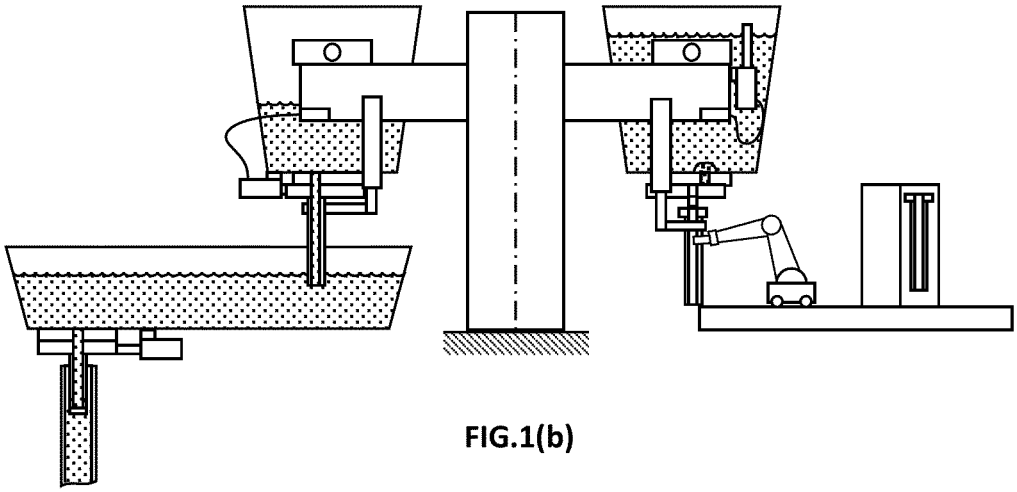
Figure 1C:
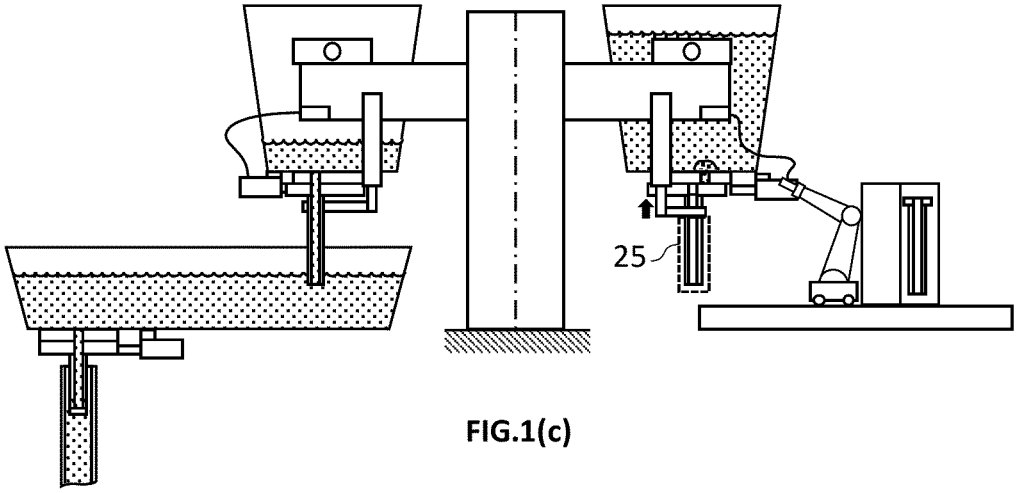
Figure 1D:
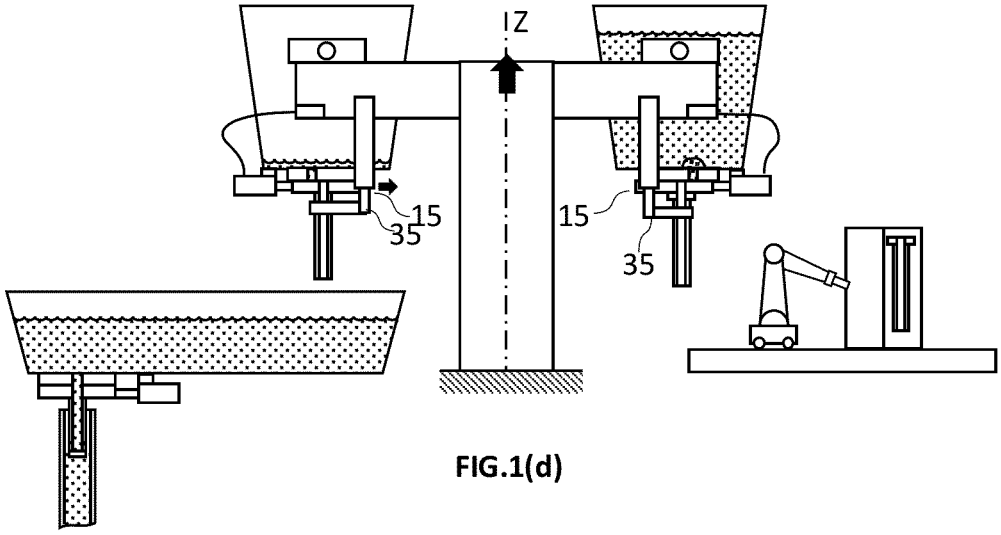
Figure 1E:
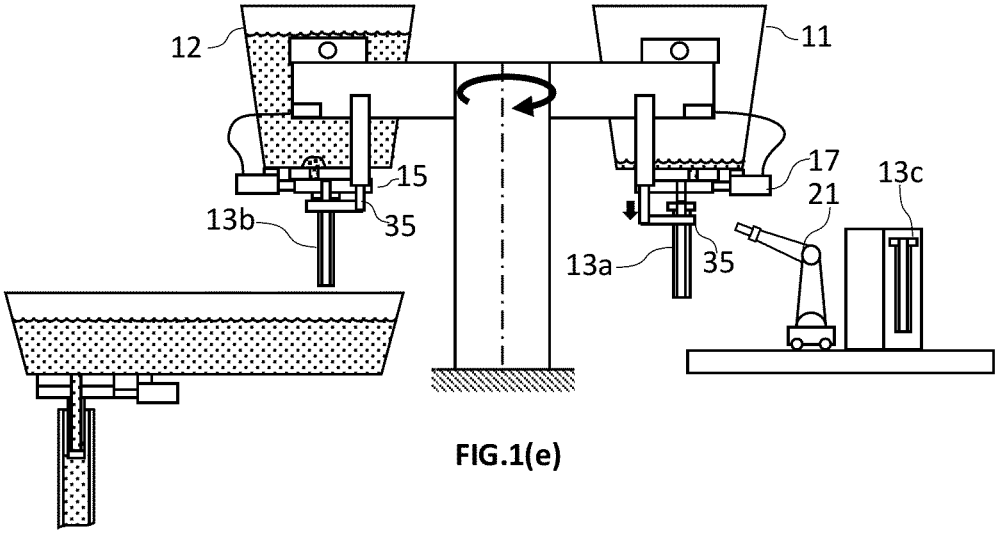
Figure 1F:
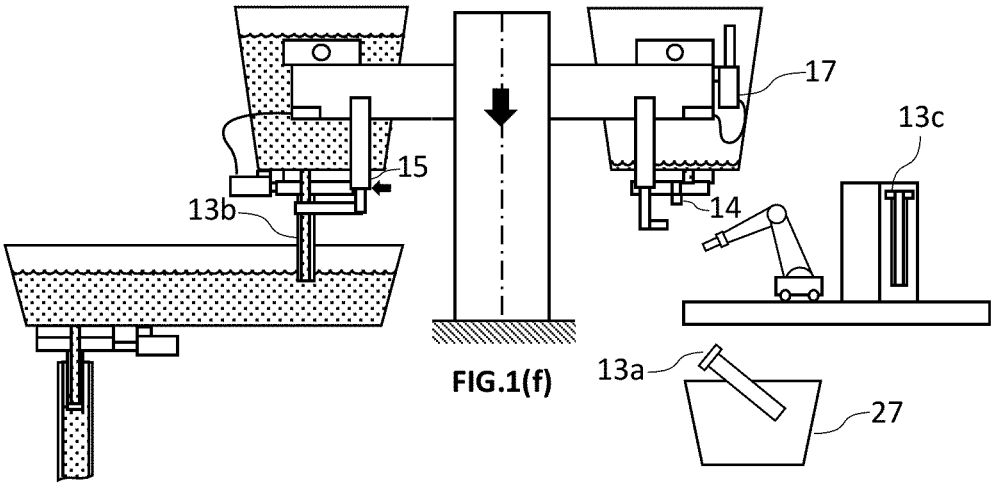
Figure 2A:
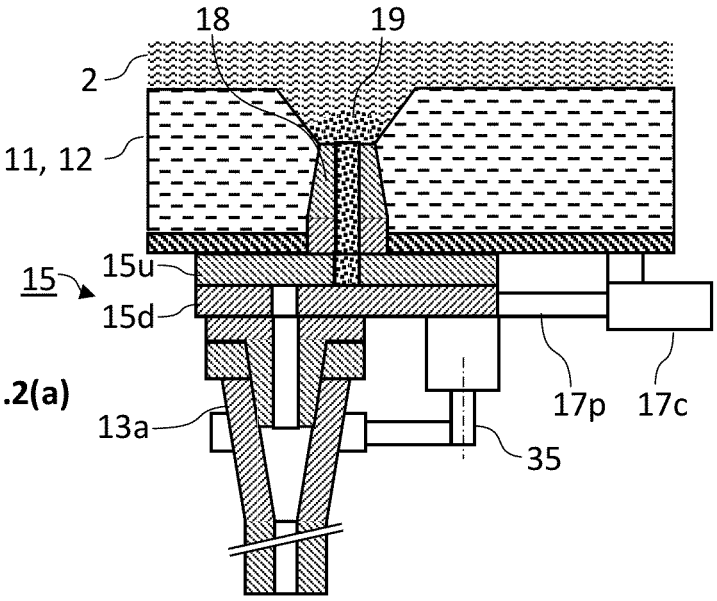
FIG. 2 shows various steps for unclogging a clogged ladle outlet using a ladle sliding gate according to a first embodiment of the present invention.
Figure 2B:
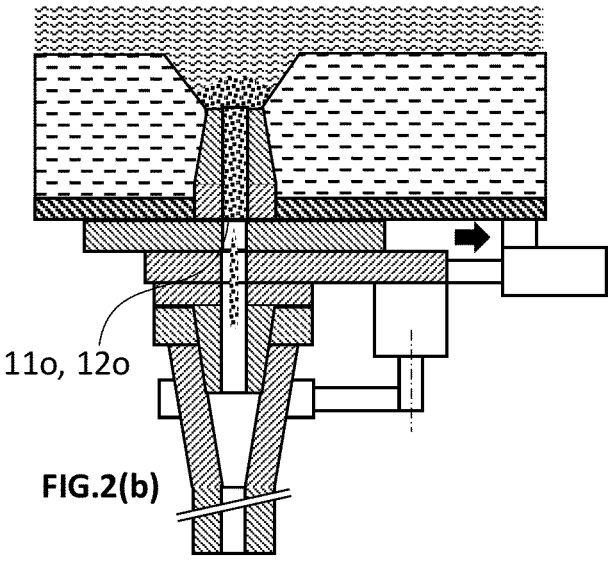
Figure 2C:
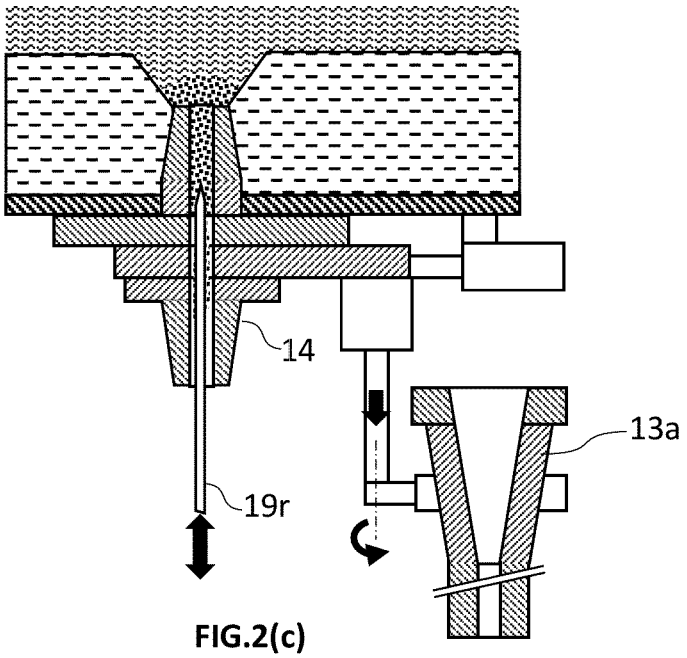
Figure 2D:
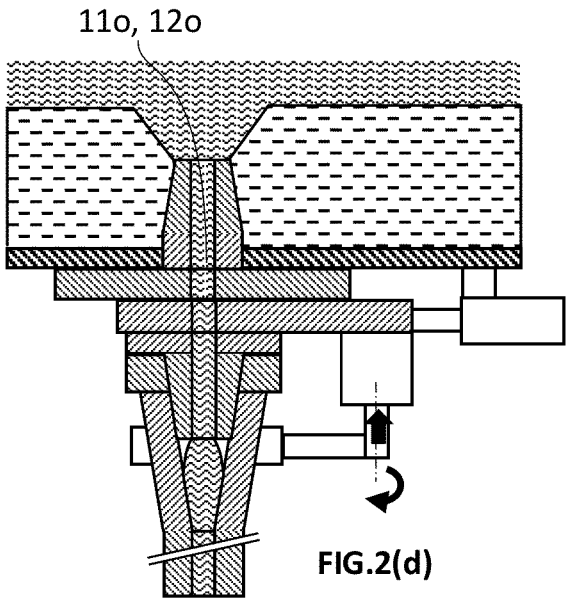
Figure 3A:
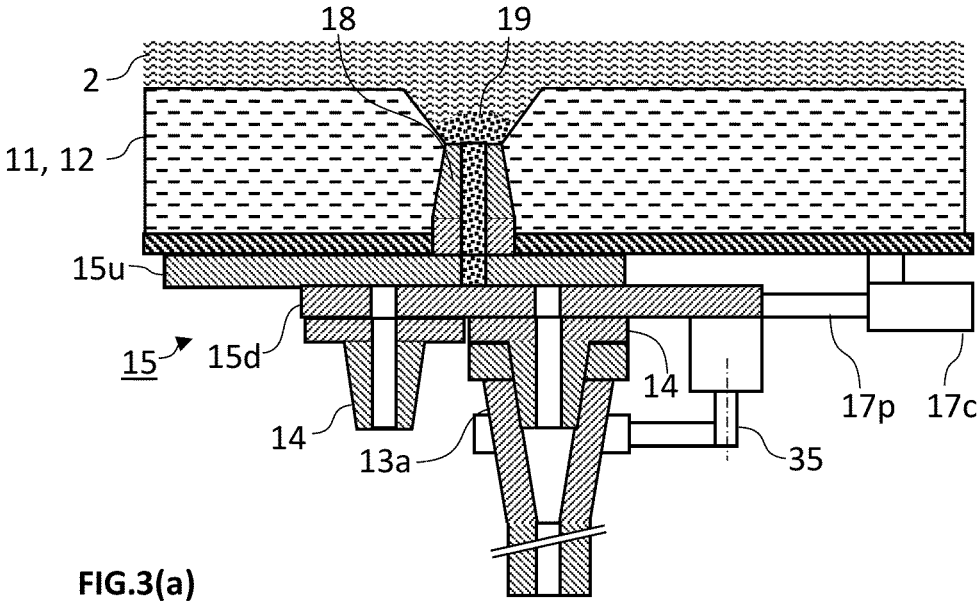
FIG. 3 shows various steps for unclogging a clogged ladle outlet using a ladle sliding gate according to a second embodiment of the present invention.
Figure 3B:
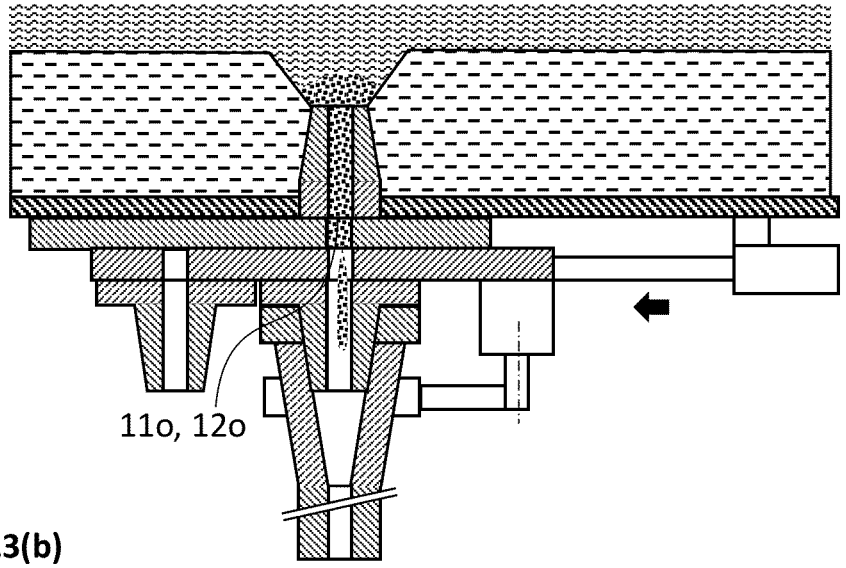
Figure 3C:
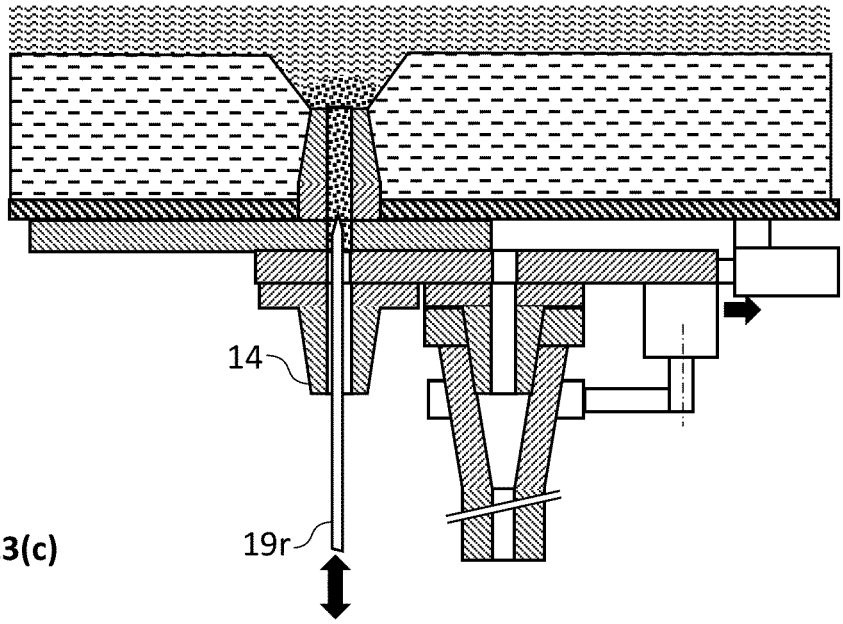
Figure 3D:
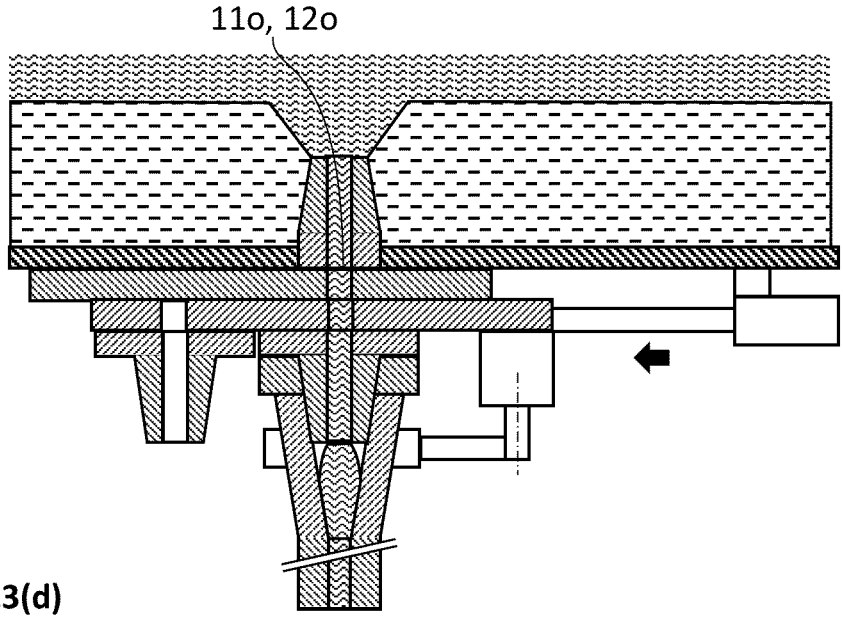

As illustrated in FIG. 1, a metal casting installation according to the present invention comprises a first ladle (11) and a second ladle (12). The first ladle is held at a casting station over a tundish (1) for transferring molten metal (2) contained in the first ladle (11) into the tundish (1). The tundish delivers the molten metal to a tool or a mould. With this system, the tundish contains a volume of molten metal which remains substantially constant throughout the transfer of molten metal from the first ladle (11) to the tundish (1). When the first ladle has been emptied of its content, it must be replaced as rapidly as possible by the second ladle (12) full of molten metal and fully geared for continuing the transfer of molten metal (2) to the tundish (1), to keep substantially constant the level of molten metal in the tundish and, at the same time, the flow rate of molten metal out of the tundish into the tool or mould.

A ladle (11,12) comprises, a floor provided with an opening (110, 120). An inner nozzle (18) provided with an inner bore brings an inner volume of the tundish in fluid communication with the opening (110, 120). The ladle (11,12) also comprises a ladle sliding gate (15) configured for reversibly receiving and supporting a collector nozzle in registry with a lower bore, and for being coupled to a driving device (17) for actuating the ladle sliding gate between a sealed position wherein the opening is sealed from the collector nozzle, and a casting position wherein the opening is in fluid communication with the collector nozzle and ladle shroud (13*a*-13*c*). The ladle shroud is coupled over the collector nozzle and thus maintained in position by a manipulator (35).

accelerate the swap between an emptied first ladle (11) with a full second ladle (12), the first and second ladles are supported by corresponding first and second holding devices of a transportation device. The transportation device can be a ladle car but is preferably a rotating turret (30) (cf. FIG. 1(*a*)). The first and second holding devices are fork shaped arms holding the first and second ladles (11,12) at "arm-length" from a central rotating axis (Z). The rotation of the turret about the central rotating axis (Z) allows the first and second ladles to be moved between, the casting station wherein one of the first or second ladle (11, 12) is held over the tundish with a ladle shroud (13*a*-13*c*) partly inserted inside the tundish, and a loading station, wherein the other one of the first or second ladle is geared at a loading station in preparation to the transfer of molten metal into the tundish when it is moved into the casting station.

Because the ladle shroud (13*a*-13*c*) is partly inserted in the tundish (1), the turret (30) must first lift the first and second ladles to drive the ladle shroud (13*a*) of the first ladle (11) out and above the tundish (1) prior to rotating about the central rotating axis (Z) to avoid the ladle shrouds of the first and second ladles to collide with the tundish.

The loading station is provided with a loading platform (20) comprising tools and spare parts, such as new ladle shrouds (13*b*, 13*c*), new collector nozzles (14), or spare driving devices (17). As explained supra, a ladle cannot be transported across a workshop between a furnace and a casting installation with a long ladle shroud (13*a*-13*c*) protruding out of the bottom floor thereof. Consequently, a fresh ladle, full of molten metal, reaches the casting station devoid of a ladle shroud (13*a*-13*c*). The fresh ladle (11, 12) full of molten metal (2) reaches the turret (30) with a ladle sliding gate (15) fixed to the bottom floor of the ladle but without an operational driving device (17), and with a collector nozzle (14) coupled to the ladle sliding gate. The collector nozzle is very short and can travel across the workshop attached to the ladle without any risk of collision. A new ladle shroud (13*a*-13*c*) can therefore be coupled to the fresh ladle (12) over the collector nozzle (14) and maintained in position when the fresh ladle is docked on the turret (30) at the loading station. At the same time, a driving device (17) must be coupled to the ladle (11, 12) and the ladle sliding gate (15) and must be activated by connecting it to a source of pressurized fluid for hydraulic or pneumatic driving devices (17), or to a source of electric power for electric driving devices (17).

Rather than carrying out these operations manually by a human operator, the present invention proposes to provide a robot (21) on or adjacent to the loading platform (20). The robot (21) is configured for loading a new ladle shroud (13*b*) onto the ladle slide gate (15), and for coupling a driving device (17) to the ladle slide gate (15).

Casting Installation

FIG. 1 illustrates various steps of a continuous casting operation with an installation according to the present invention. The swapping of an emptied first ladle (11) with a filled second ladle (12) is discussed more in detail in the following sections. FIG. 1(*a*) shows a turret (30) as transportation device, comprising a first and second holding devices for holding first and second ladles (11, 12). The turret is located adjacent to a tundish, such that each of the first and second holding devices can bring a ladle (11, 12) to the casting station, with the ladle shroud partly inserted in the tundish below the level of molten metal contained in the tundish during use in stationary conditions. FIG. 1(*a*) shows such configuration, with a first ladle (11) partly filled with molten metal held at the casting station by the first holding device of the turret (30). The first ladle is over the tundish (1) with the ladle nozzle (13*a*-13*c*) held in place by a ladle shroud manipulator (35) fixed to the first holding device of the turret (30), such that the ladle shroud is partly inserted into the tundish and partly immerged below the level of molten metal contained in the tundish. The ladle sliding gate (15) of the first ladle (11) is coupled to a driving device (17) configured to move a plate of the sliding gate between the sealing and casting positions described supra. In the embodiment of FIG. 1, the driving device (17) is a hydraulic piston which is connected to a source (17*h*) of pressurized fluid, through a hose (17*t*). The driving device (17) can be pneumatic or electric, but hydraulic driving devices are preferred.

A second ladle (12) full of molten metal, coming straight from a furnace, is held at the loading station by the second holding device of the turret (30), at the loading station, within robot reach of the loading platform (20). The ladle sliding gate (15) of the second ladle (12) is in the sealed position. Unlike the first ladle (11), the second ladle (12) is not ready for casting molten metal because it is devoid of any ladle shroud (13*b*) and of any driving device (17). It is possible to bring a second ladle (12) already equipped with a driving device (17), but not in an operational state, since it would not be connected to any source of pressurized fluid for hydraulic and pneumatic driving devices, nor to any source of electric power for electric driving devices. Generally, the second ladle (12) when reaching the turret is devoid of any driving device (17), and in the few instances where it is provided with a driving device, the latter is not operational.

The loading platform (20) comprises a storage rack (29) with various tools (not shown) required for preparing the second ladle (12) for casting, and with spare ladle shrouds (13*b*, 13*c*). The ladle shroud (13*a*-13*c*) first in line for being coupled to a ladle is preferably preheated in the storage rack (29) or in a separate oven within reach of the robot, to avoid any brutal thermal shock when molten metal flows through the ladle shroud upon starting of the casting operation at the casting station. In some instances, the platform can comprise spare driving devices (17), and possibly spare collector nozzles (14), although a collector nozzle (14) is preferably coupled to the second ladle in a separate, refurbishing station, prior to filling the ladle with molten metal from the furnace.

The driving device (17) for actuating the ladle sliding gate (15) of the second ladle (12) is preferably stored on or at proximity of the second holding device of the turret (30). It is preferred to store the driving devices on the first and second holding devices because this way, it is not necessary to connect and disconnect the (drawer) driving devices each time it is coupled to and removed from a ladle, as the source (17*h*) of pressurized fluid is most conveniently also located on or at proximity of the first and second holding devices, as shown in FIG. 1(*a*).

FIG. 1(*b*) shows that, while the first ladle (11) is discharging its content of molten metal into the tundish, the robot (21) takes a new ladle shroud (13*b*) from the storage rack (29) and couples the new ladle shroud to the ladle sliding gate (15) of the second ladle (12), which is maintained in the sealed position during the whole stay of the second ladle at the loading station. As explained supra, in a preferred embodiment, the new ladle shroud (13*b*) is heated to a pre-heating temperature in the storage rack (29) or in a separate oven within reach of the robot (21), prior to being loaded onto the ladle sliding gate. Pre-heating the ladle shroud prior to casting reduces the risks of cracking due to a brutal thermal shock as molten metal starts flowing through the ladle shroud at the beginning of a casting operation. As a second ladle (12) provided with a new ladle shroud (13*b*) can remain a certain time stationed at the loading station before being moved to the casting station, as the first ladle (11) is delivering molten metal to the tundish and is getting emptied, the new ladle shroud (13*b*) has time to cool down, losing all the benefit of the pre-heating operation. For this reason, in a preferred embodiment of the present invention illustrated in FIG. 1(*c*), additionally or alternatively to pre-heating the new ladle shroud in the storage rack or separate oven, a pre-heating oven (25) can be provided at the loading station for (optionally bringing and) maintaining at the pre-heating temperature the new ladle shroud (13*b*) held by the manipulator over the collector nozzle (14) of the ladle sliding gate (15) of the second ladle (12) located at the loading station. With this pre-heating oven (25), the ladle shroud arrives at the casting station at the required pre-heating temperature, and casting can start with lower risk of cracking due to thermal shocks. The pre-heating oven (25) can be movingly coupled to the loading platform (20), or to the first and second holding devices of the turret. It is preferably in the form of an open book, closing over the new ladle shroud (13*b*) once it has been loaded on the ladle sliding gate (15). The robot (21) can handle the oven to bring it into pre-heating position.

The robot (21) can preferably move along a horizontal plane (X, Y) and has several degrees of liberty, preferably at least five or at least seven degrees of liberty. The robot must be able to reach both the storage rack (29) to collect or deposit tools and or casting components, and also to reach the ladle shroud manipulator (25) of the ladle stationed at the loading station. It must have enough degrees of liberty for carrying out all the connections and de-connection and couplings and de-couplings required for ensuring a continuous casting operation of the casting installation.

In particular, as shown in FIGS. 1(*b*) and 1(*c*) the robot must be configured for handling over a new ladle shroud (13*b*) to the manipulator (35) and for recovering a spent ladle shroud from an empty ladle off the manipulator (35). The robot must also be configured for (de-)coupling a driving device (17) to the ladle sliding gate (15 and ladle, and for (de-)coupling a hose (17*t*) to (from) the driving device (17). In FIG. 1, the first and second holding devices of the turret (30) are provided with both,

- a storing station for storing one or more (drawer) driving devices (17) and
- a source of pressurized fluid connected to the one or more (drawer) driving devices for actuating the ladle sliding gate (15).

With this configuration, all the robot (21) needs to do is to collect the driving device (17) from its storing station at the second holding device and couple it to the ladle and ladle sliding gate (15). In case the driving device is stored in the storage rack (29) or in case the driving device stored in the storing station must be changed with a new one stored in the storage rack (29), additionally to coupling the one or more (drawer) driving devices (17) to the ladle and ladle sliding gate (15), the robot (21) must also connect one or more hoses (17*t*) to corresponding (drawer) driving devices to render the driving device operational for actuating the ladle sliding gate.

The ladle shroud manipulator (35) (or simply "manipulator") follows a ladle (11, 12) during all operations thereof as the ladle is supported by the transportation device such as a turret (30) or a ladle car. In a first embodiment, the manipulator can be fixed to the first and second holding devices of the transportation device as illustrated in FIGS. 1 and 3. This solution is advantageous in that the manipulator remains coupled to the transportation device for the whole duration of one or more casting operations, and must not be changed every time a new ladle reaches the transportation device. Alternatively, according to a second embodiment, the manipulator can be fixed to the ladle sliding gate (15), preferably moving together with the lower plate (15*d*), as illustrated in FIGS. 2(*a*) to 2(*d*). This solution does not have the advantage of the previous embodiment, since the manipulator must be coupled and de-coupled to and from the ladle sliding gate every time a new ladle reaches and leaves the corresponding holding device of the transportation device, but it has the advantage that the manipulator needs not be synchronized with the driving device (17) to ensure that the ladle shroud held by the manipulator follows the same movements as the collector nozzle (14), which movements are controlled by the driving device (17).

As shown in FIG. 1(*d*), when the first ladle (11) is substantially empty, it must be replaced by the full, second ladle (12) which is waiting at the loading station. In the embodiment illustrated in FIG. 1, the turret (30) is configured for raising the first and second ladles (11,12) to a rotating altitude, to ensure that, upon rotation of the turret, the ladle shrouds (13*a*, 13*b*) of the first and second ladles do not collide with the tundish (1) or with any other element of the casting installation. As shown in FIG. 1(*e*) the turret (30) is also configured for rotating about a vertical axis (Z) such as to swap in a single movement the positions of the first and second ladles, still maintained at the rotating altitude above the respective loading and casting positions. Finally, the turret (30) must be configured to lower both first and second ladles to their corresponding loading and casting stations as shown in FIG. 1(*f*). The manipulators (35) follow the movements of raising, rotating, and lowering of both ladles, regardless of whether the manipulators are fixed to the first and second holding devices or to the ladle shroud sliding gate (15).

The movements of the turret and of the ladle sliding gates (15) of both first and second ladles must be perfectly synchronized to prevent any undesired dripping or flow of molten metal from any of the first and second ladles.

The robot (21) must also be configured for taking the emptied first ladle (11) located at the loading station from the corresponding manipulator (35) after the latter disengaged the ladle shroud (13*a*) from the collector nozzle (14). The robot is also configured for de-coupling the driving device (17). The spent ladle shroud (13*a*) can be cleaned and stored for further use or it can be disposed of into a disposal bin (27) as shown in FIG. 1(*f*). The driving device (17) can be stored in the storing station on the first holding device of the turret (30) without having to disconnect it from the source of pressurized fluid, or into the storage rack (29) of the loading platform, after having disconnected the source of pressurized fluid therefrom. If the manipulator (35) is fixed to the ladle shroud sliding gate (15), the robot is configured for de-coupling the manipulator from the ladle sliding gate and storing it in the rack (29) for the next ladle to be loaded onto the first holding device of the transportation device. The emptied first ladle (11) stripped of both ladle shroud (13*a*) and driving device (17) and optionally manipulator can now be removed to a service station for being refurbished. A new ladle full of molten metal can be brought from the furnace and loaded onto the now empty first holding device of the turret, for starting the whole operations as illustrated in FIGS. 1(*a*) to 1(*f*) discussed supra.

The Robot (21)

The robot (21) can have at least five, preferably at least six or seven degrees of liberty. The robot is preferably movingly mounted on the loading platform (20) such that the robot can translate parallel to a first axis (X) and/or second axis (Y) normal to the first axis (X), or combination thereof. The robot (21) can preferably rotate about a vertical axis (Z) normal to the first and second axes (X, Y). With these combinations of movements, the robot must be able to reach and retrieve any tool or component from the storage rack (29) and to reach the ladle sliding gate (15) of the first or second ladle (11, 12) which is held at the loading station for carrying out the operations described below. Excellent results were obtained using a Kuka Foundry type Robot KR480.

The robot may comprise a base in communication with motion-producing components such as wheels or treads. The base may be in communication with an arm; the arm may be rotatably, fixedly, and/or pivotally attached to the base. The arm may be extensible. The arm may be provided with one or more segments joined to one another by pivots or rotatable joints. The arm may be provided with a holding device such as a clamp, a housing, a receptacle, a support, tongs, and the like, configured for engaging, manipulating, handling, coupling, gripping and/or moving a driving device (17), a ladle shroud (13*a*-13*c*), a tool, or a manipulator (35).

The robot is configured for coupling a driving device (17) to a ladle (11, 12) full of molten metal and to the ladle sliding gate (15) thereof. It is also configured for removing off the emptied first or second ladle (11, 12) which is held at the loading station after being moved from the casting station the driving device (17). The robot (21) is configured for handling a new ladle shroud to the manipulator (35), as well as for removing a spent ladle shroud (13*a*-13*c*) from the manipulator of an emptied ladle (11, 12). Finally, and only in case the manipulators are not fixed to the first and second holding devices of the transportation device, the robot is configured for coupling and de-coupling the manipulator to the ladle located at the loading station. To avoid brutal thermal shocks, the ladle shroud (13*b*) is preferably enclosed in a pre-heating station prior to being coupled to the ladle sliding gate (15) of the ladle at the loading station. The robot can handle the ladle shroud from the storage rack (29) to the pre-heating station (not shown) and thence to the manipulator (35). Similarly, for removing the ladle shroud off an emptied first ladle (11), the robot can take hold of the ladle shroud from the manipulator after the latter de-coupled the ladle shroud from the collector nozzle. The robot can bring the removed ladle shroud to a pressurized gas (e.g. oxygen) cleaning station (not shown) and to the pre-heating station or to the storage rack (29) for further use. Alternatively, the robot can dump the ladle shroud into a disposal bin (27) in case it is too worn out for further use (cf. FIG. 1(*f*)).

The robot is also configured for checking the state of a spent ladle shroud (13*a*-13*c*) after removal from an emptied ladle. In a preferred embodiment, the robot is configured for assessing whether the spent ladle shroud can be re-used after cleaning or whether it must be disposed of. This can be achieved with an artificial intelligence programming of the robot which can "learn" to distinguish between spent ladle shrouds which can be re-used or must be disposed of. The robot is also preferably configured for cleaning a spent ladle shroud, with an oxygen shower, to remove any residue clinging to walls of the spent ladle shroud.

Ladle Sliding Gate (15)

A ladle sliding gate (15) suitable for the present invention comprises an upper plate (15*u*) and a lower plate (15*d*). The upper plate comprises a fixing surface and a bottom sliding surface separated from one another by a thickness of the upper plate, and an upper bore extending from the fixing surface to the bottom sliding surface. The fixing surface of the upper plate is rigidly fixed to a lower portion of the corresponding first or second ladle (11, 12) with the upper bore in fluid communication with the opening (110, 120). The opening is generally formed by a downstream end of an inner bore of an inner nozzle (18), as illustrated in FIGS. 2(*a*) and 3(*a*). During a whole casting operation from a ladle (11, 12) into a tundish (1), the upper plate (15*u*) is fixed with respect to the opening (110, 120) and to the inner nozzle (18).

The lower plate (15*d*) comprises a nozzle surface and a top sliding surface separated from one another by a thickness of the lower plate, as well as one or two lower bores extending from the top sliding surface to the nozzle surface. In a first embodiment, the lower plate comprises a single first lower bore. In a second embodiment, the lower plate comprises first and second bores. Both embodiments are discussed in detail below. The lower plate (15*d*) is slidingly mounted such that the top sliding surface can slide in translation along the bottom sliding surface to bring the one or two lower bores in and out of fluid communication with the upper bore. The lower plate can be moved in translation by activating a driving device (17). The driving device can comprise a cylinder (17*c*) rigidly and reversibly coupled to the bottom portion of the first or second ladle (11, 12), and a piston (17*p*) reversibly fixed to the lower plate (15*d*).

The driving device (17) can be actuated hydraulically or pneumatically or electrically. Each of the at least first holding device and second holding device of the ladle turret is preferably provided with a source of pressurized fluid for actuating the driving device (17) via a hose (17*t*). In a preferred embodiment, each of the at least first holding device and second holding device of the ladle turret also comprises a storing unit for storing the driving device (17) when the driving device (17) is not coupled to the ladle sliding gate (15), as shown in FIGS. 1(*a*), 1(*b*), and 1(*f*). The casting devices (17) can also be stored in the storage rack on the loading platform. It is, however, preferred to store them on the first and second holding devices, because this way, the driving devices (17) can be permanently coupled via the hose (17*t*) to the source of hydraulic or pneumatic fluid (17*h*). This saves the robot (21) from having to carry out a complex operation of coupling the hose (17*t*) to the newly coupled driving device(s) (17), which would have to be carried out in case the driving devices (17) were stored in the storage rack (29) on the loading platform.

First Embodiment: Lower Plate (15d) Comprises a Single First Lower Bore

In the first embodiment illustrated in FIGS. 2(*a*) to 2(*d*), the lower plate (15*d*) comprises a single first lower bore. A collector nozzle (14) is rigidly (and reversibly) coupled to the nozzle surface of the lower plate. The top sliding surface surrounds an inlet of the single first lower bore and has a surface area sufficient to seal an outlet of the upper bore (18) when the ladle sliding gate is in the sealed position, as illustrated in FIG. 2(*a*). The ladle shroud (13*a*-13*c*) is coupled by the manipulator (35) over the collector nozzle, with the collector nozzle inserted in the ladle bore.

FIGS. 2(*a*) to 2(*d*) show various steps for initiating a casting operation from a ladle (11, 12) to a tundish (1) with a ladle sliding gate according to the first embodiment. FIG. 2(*a*) shows a new ladle (11, 12) having reached the casting station. The ladle sliding gate is in the sealed position with the single first bore of the lower plate (15*d*) being out of registry from the upper bore of the upper plate (15*u*). The inner bore of the inner nozzle (18) as well as the upper bore are filled with a plugging material (19), which can be sand or any other particulate material, for preventing freezing of the sliding mechanism by solidified metal. Neither the molten metal (2) nor the plugging material (19) is allowed to flow through the ladle sliding gate, since the downstream end of the upper bore is sealed by the lower plate. Once the ladle is at the casting station, casting can start.

As shown in FIG. 2(*b*), to start casting, the driving device (17) translates the lower plate and ladle shroud (13*a*-13*c*) until bringing the lower bore and ladle bore in fluid communication with the upper bore, thus forming a continuous flow channel from the inner bore to the shroud bore. In case, as shown in FIGS. 2(*a*) to 2(*d*), the manipulator (35) is coupled to the lower plate such as to move together with the lower plate, then the ladle shroud (13*a*-13*c*) held in place by the manipulator moves together with the collector nozzle (14) fixed to the lower plate (15*d*). In case the manipulator is coupled to the first or second holding device of the transportation device, as illustrated in FIGS. 1(*a*) to 1(*f*) and 6, then the manipulator must be synchronized with the driving device such that when the lower plate (15*d*) of the ladle sliding gate is moved, the manipulator ensures that the ladle shroud follows the same movements as the lower plate and thus remains coupled to the collector nozzle (14) without breaking any parts.

In normal conditions, the plugging material (19) flows out through the lower bore and shroud bore, driven by the pressure of the molten metal in the ladle. Once the plugging material (19) has been evacuated, molten metal flows out of the ladle through the shroud bore. This operation takes a few seconds, and casting from the tundish to the tool can proceed continuously. As discussed in the Background of the Invention, however, in some cases, a solidified mass of plugging material (19) can clog the inner and upper bores, so that no molten metal can flow out of the ladle and the passage must be unclogged. With a casting installation according to the first embodiment of the present invention, a clogged inner bore and/or upper bore can be unclogged very rapidly, as follows.

Figure 4A:
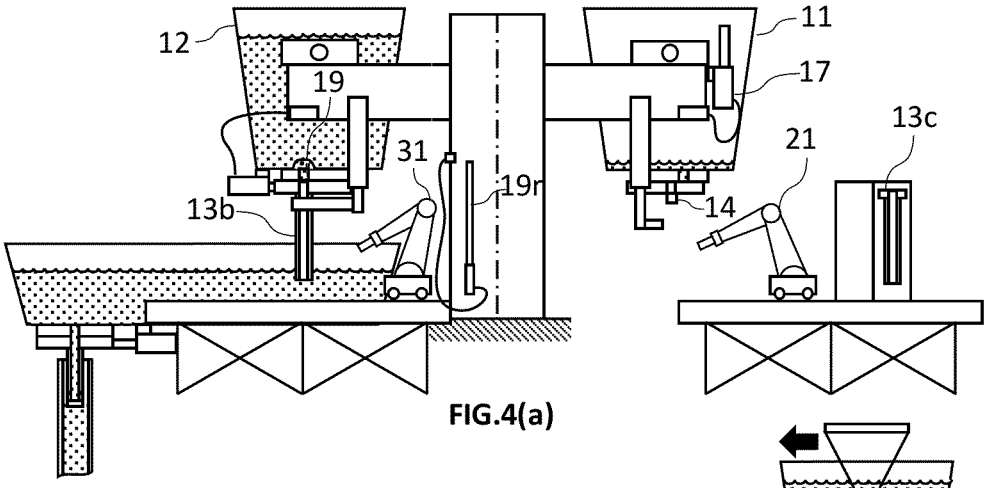
FIG. 4 shows various alternative steps for unclogging a clogged ladle outlet using a ladle sliding gate according to the first embodiment of the present invention.
Figure 4B:
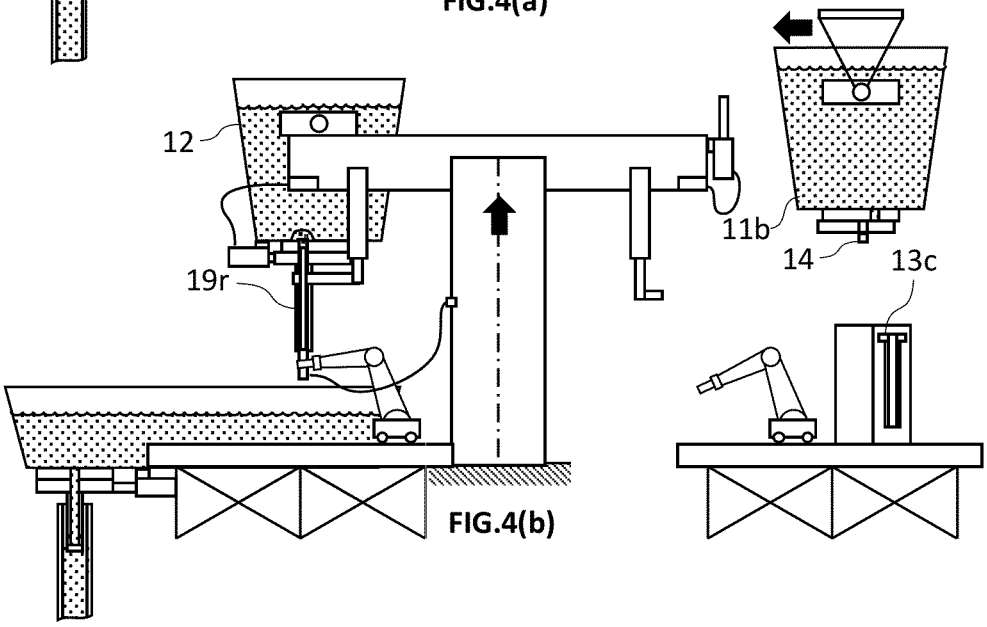
Figure 4C:
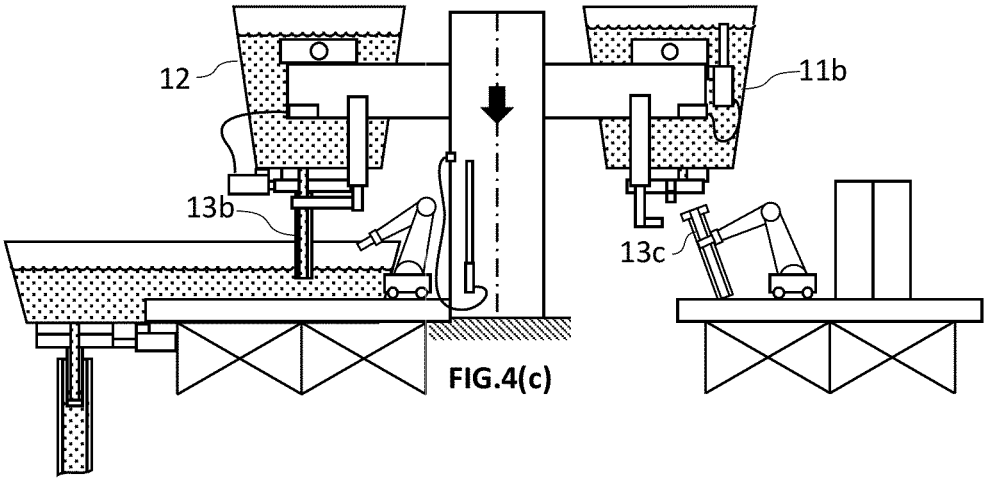

As shown in FIG. 2(*c*), the manipulator (35) de-couples the ladle shroud (13*a*-13*c*) from the collector nozzle (14) by lowering the ladle shroud and driving it away such as to give access to a downstream end of the collector nozzle bore. Since the collector nozzle is substantially shorter than the ladle shroud, leaving enough clearance above the tundish, it is easy to introduce an unclogging tool (19*r*) through the downstream end of the collector nozzle, through the lower and upper bores and up to the inner bore. The unclogging tool can be a metal staff which can be used to break the solidified mass by hitting the thus solidified plugging material. Alternatively, the unclogging tool (19*r*) can be as shown in FIG. 4(*b*) a pressurized gas lance, projecting a jet of pressurized gas, such as oxygen. The unclogging tool (19*r*) can be handled manually or by a robot (31) located at the casting station.

As soon as the solid mass is disrupted, the particles of plugging material (19) start flowing out through the collector nozzle. The manipulator (35) can bring the ladle shroud over the collector nozzle with the ladle sliding gate being either in the sealed position or the casting position. In the sealed position, the manipulator can couple the ladle shroud without haste. In the casting position, the coupling operation must be swift to prevent molten metal from flowing out of the collector nozzle prior to the coupling of the ladle shroud thereover. As shown in FIG. 2(*d*), once the ladle shroud is coupled over the collector nozzle, the ladle sliding gate must be brought to the casting position if it was in the sealed position, and casting can start normally.

Alternatively, unclogging a clogged bore in a ladle equipped with a ladle sliding gate (15) according to the first embodiment can also be carried out in the following manner illustrated in FIGS. 4(*a*) to 4(*c*). FIG. 4(*a*) shows a metal casting installation with an empty first ladle (11) parked at the loading station before being removed, and a full second ladle (12) positioned at the casting station, with the lower plate (15*d*) of the ladle sliding gate in casting position. This situation is equivalent to the one illustrated in FIG. 2(*b*), wherein the lower bore and ladle bore are in fluid communication with the upper bore, thus forming a continuous flow channel from the inner bore to the shroud bore.

In case, as discussed in the Background of the Invention, the inner and upper bores were clogged, preventing the molten metal from flowing out of the ladle, then the passage must be unclogged. With a casting installation according to the first embodiment of the present invention, a clogged inner bore and/or upper bore can be unclogged very rapidly, in a manner illustrated in FIGS. 4(*a*) to 4(*c*), as follows.

As shown in FIG. 4(*b*), the turret (30) (or other transportation device) lifts the full second ladle (12) until the ladle shroud is out of the tundish, with sufficient clearance above the top of the tundish to access an outlet of the ladle shroud with an unclogging tool (19*r*) to be introduced through the outlet of the ladle shroud, through the collector bore, lower bore, upper bore, and up to the inner bore. The unclogging tool can be a metal staff which can be used to break the solidified mass by hitting the thus solidified plugging material. As shown in FIG. 4(*b*), the unclogging tool (19*r*) is preferably a pressurized gas lance, projecting a jet of pressurized gas, such as oxygen. The unclogging tool (19*r*) can be handled manually or by a robot (31) located on a casting platform at the casting station. In this embodiment, the unclogging tool is preferably telescopic, to facilitate introduction thereof through the outlet of the ladle shroud with minimal clearance. In an alternative embodiment, a pressurized gas lance (19*r*) can be integrated to the ladle shroud. This solution increases the cost of the ladle shrouds used and requires connecting the integrated lance to a source of pressurized gas prior to casting.

As soon as the solid mass is disrupted, the particles of plugging material (19) start flowing out through the collector nozzle and ladle shroud. As shown in FIG. 4(*c*), the turret (30) lowers the second ladle (12) into casting position as the lower plate is either in the sealed or casting position. In the sealed position, the turret can lower the ladle without haste. In the casting position, the lowering operation must be swift to prevent molten metal from flowing out of the tundish prior to the ladle shroud being introduced into the tundish. At this stage, casting can start normally.

Unclogging the upper and inner bores through the shroud bore by lifting the ladle and ladle shroud out of the tundish is made possible because the manipulator (35) is fixed either to the holding device, to the ladle, or to the ladle sliding gate, and is lifted together with the ladle. In prior art metal casting installations, wherein the ladle shroud is held in place by a robot (31) located on a casting platform at the casting station, this would not be possible as the robot (31) could not hold the ladle shroud at such high position as required by the present un-clogging method.

FIGS. 4(*a*) to 4(*c*) also show the replacement of an empty ladle (11) (12) parked at the loading station by a new full ladle (11 *b*). The new ladle (11 *b*) full of molten metal is brought from a furnace to the metal casting installation with a crane. The new ladle (11 *b*) is already equipped with a ladle sliding gate (15) in the sealing position with a collector nozzle (14) coupled to the lower plate (15 *d*) of the ladle sliding gate, but does not carry any ladle shroud (13 *a*-13 *c*), nor any driving device (17). Once the new ladle (11 *b*) is loaded onto the turret (30), the robot (21) can hand a new ladle shroud (13 *c*) to the manipulator (35), and the driving device (17) can be coupled to the ladle sliding gate, as explained supra.

Second Embodiment: Lower Plate (15*d*) Comprises First and Second Bores

In a second embodiment illustrated in FIGS. 3(*a*) to 3(*d*), the lower plate (15*d*) comprises a first lower bore and a second lower bore, each extending from the top sliding surface to the nozzle surface. The lower plate (15*d*) is slidingly mounted such that the top sliding surface can slide along the bottom sliding surface to bring each of the first and second lower bores in and out of fluid communication with the upper bore. First and second collector nozzles (14) are rigidly and reversibly coupled to the nozzle surface with the collector bores of the first and second collector nozzles (14) in fluid communication with the first and second lower bores, respectively. The top sliding surface surrounds the inlets of both first and second lower bores and has a surface area sufficient to seal an outlet of the upper bore when the ladle sliding gate is in the sealed position, as illustrated in FIG. 3(*a*). The ladle shroud (13*a*-13*c*) is coupled by the manipulator (35) over the first collector nozzle, with the first collector nozzle nested in the ladle bore.

FIGS. 3(*a*) to 3(*d*) show various steps for initiating a casting operation from a ladle (11, 12) to a tundish (1) with a ladle sliding gate according to the second embodiment. FIG. 3(*a*) shows a new ladle (11, 12) having reached the casting station. The ladle sliding gate is in the sealed position with both first and second lower bores of the lower plate (15*d*) being out of registry from the upper bore of the upper plate (15*u*). The inner bore of the inner nozzle (18) as well as the upper bore are filled with a plugging material (19), which can be sand or any other particulate material, for preventing freezing of the sliding mechanism by solidified metal. Neither the molten metal (2) nor the plugging material (19) is allowed to flow through the ladle, since the downstream end of the upper bore is sealed by the lower plate. Once the ladle is at the casting station, casting can start.

As shown in FIG. 3(*b*), to start casting, the driving device (17) translates the lower plate and ladle shroud (13*a*-13*c*) until bringing the first lower bore and ladle bore in fluid communication with the upper bore, thus forming a continuous flow channel from the inner bore to the shroud bore. In case, as shown in FIGS. 3(*a*) to 3(*d*), the manipulator (35) is coupled to the lower plate such as to move together with the lower plate, then the ladle shroud (13*a*-13*c*) held in place by the manipulator moves together with the collector nozzle (14) fixed to the lower plate (15*d*). In case the manipulator is coupled to the first or second holding device of the transportation device, as illustrated in FIGS. 1(*a*) to 1(*f*) and 6, then the manipulator must be synchronized with the driving device such that when the lower plate (15*d*) of the ladle sliding gate is moved, the manipulator ensures that the ladle shroud follows the same movements as the lower plate and thus remains coupled to the collector nozzle (14) without breaking any parts.

In normal conditions, the plugging material (19) flows out through the lower bore and shroud bore, driven by the pressure of the molten metal in the ladle. Once the plugging material (19) has been evacuated, molten metal flows out of the ladle through the shroud bore. This operation takes a few seconds, and casting from the tundish to the tool can proceed continuously. As discussed in the Background of the Invention, however, in some cases, a solidified mass of plugging material (19) can clog the inner and upper bores, so that no molten metal can flow out of the ladle and the passage must be unclogged. With a casting installation according to the first embodiment of the present invention, a clogged inner bore and/or upper bore can be unclogged very rapidly, as follows.

As shown in FIG. 3(*c*), the lower plate (15*d*) is moved to bring the second lower bore in fluid communication with the upper bore. Unlike the un-clogging method discussed supra in relation with FIGS. 2(*a*) to 2(*d*), the ladle shroud (13*a*-13*c*) can remain coupled to the first collector nozzle during the whole un-clogging operation. Since the second collector nozzle is devoid of any ladle shroud and is thus substantially shorter than the first collector nozzle with the ladle shroud coupled thereto, enough clearance above the tundish is left below the second collector nozzle. It is therefore easy, as shown in FIG. 3(*c*), to introduce an unclogging tool (19*r*) through the downstream end of the second collector nozzle, through the second lower bore, upper bore, and up to the inner bore. The unclogging tool can be a metal staff which can be used to break the solidified mass by hitting the thus solidified plugging material. Alternatively, the unclogging tool (19*r*) can be as shown in FIG. 4(*b*) a pressurized gas lance, projecting a jet of pressurized gas, such as oxygen. The unclogging tool (19*r*) can be handled manually or by a robot (31) located on a casting platform at the casting station.

As soon as the solid mass is disrupted, the particles of plugging material (19) start flowing out through the collector nozzle. As shown in FIG. 3(*d*), the lower plate can be moved to the casting position, with the first collector nozzle and ladle shroud coupled thereto in fluid communication with the inner bore. At this point, casting can start and proceed normally.

Manipulator (35)

The manipulator (35) can be considered as a simplified robot, having fewer degrees of liberty and configured for carrying out a limited number of rather simple movements. The manipulator comprises an arm (35*a*) provided at one end thereof with gripping elements (35*g*) for firmly gripping a ladle shroud received from the robot (21), and for releasing the ladle shroud when the robot is ready for removing the ladle shroud from an emptied ladle (11, 12). The manipulator is configured for allowing, on the one hand, the arm (35*a*) to move up and down along a direction parallel to an axis (Z) of the collector nozzle bore and, on the other hand, the gripping elements (35*g*) to move along a plane parallel to a plane (X, Y) normal to the axis (Z).

For coupling a ladle shroud to a collector nozzle, the movements over the plane (X, Y) of the gripping elements allow the ladle shroud to be positioned in registry with the collector nozzle (14), and the movements up along the axis (Z) of the arm (35*a*) allow the ladle shroud to be coupled to the collector nozzle which is inserted within an upstream end of the ladle shroud bore, as shown in FIGS. 2(*a*), 2(*a*), and 2(*d*).

For de-coupling a ladle shroud from a collector nozzle (14), the movements down along the axis (Z) of the arm (35*a*) allow the ladle shroud to be de-coupled from the collector nozzle with sufficient clearance for the gripping elements to move the ladle shroud over the plane (X, Y) to give access to the collector nozzle bore for unclogging the bores as shown in FIG. 2(*c*), or for handling it to the robot (21) for removing the ladle shroud for refurbishing or disposal, as shown in FIGS. 1(*e*) and 1(*f*).

Figures 5A, 5B, 5C:
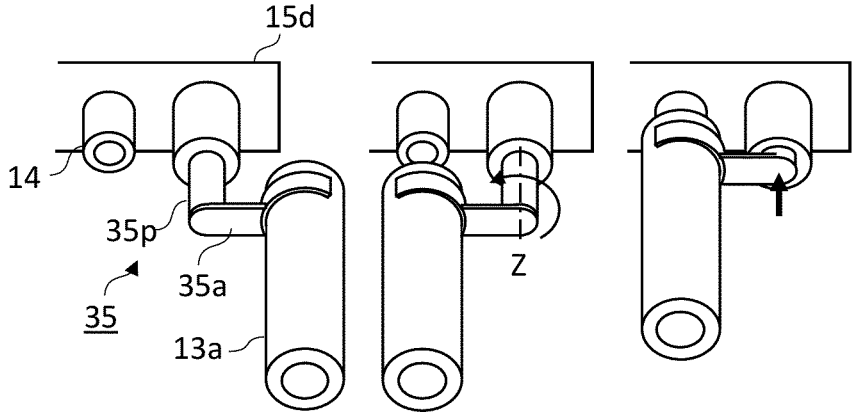
FIG. 5 shows various steps of loading a new ladle shroud over a collector nozzle using a manipulator according to an embodiment of the present invention.
Figure 6:
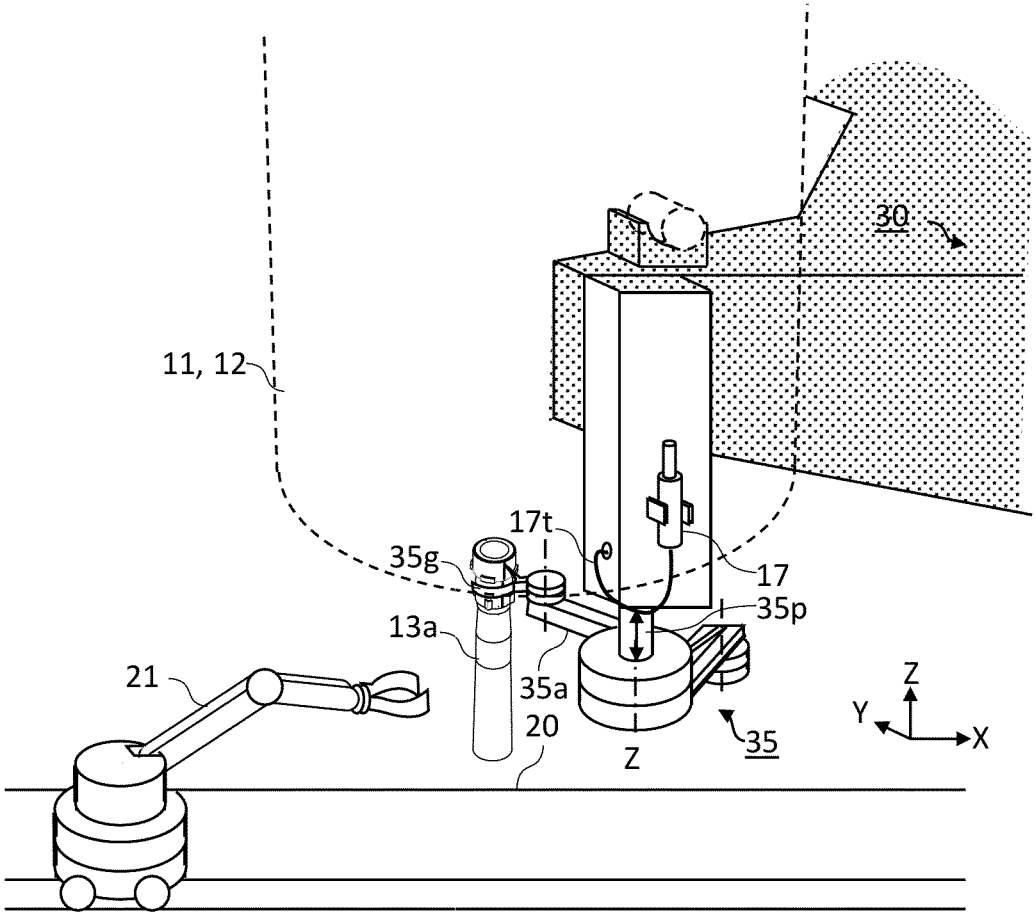
FIG. 6 shows a loading station comprising a robot, and a full ladle supported by a transportation device equipped with a manipulator according to an embodiment of the present invention.

In an embodiment, the manipulator comprises a piston (35*p*) configured for driving the up and down movements parallel to the axis (Z) (cf. FIGS. 5(*a*) to 5(*c*) and 6). The arm (35*a*) is configured for rotating about a central axis of the piston, parallel to the axis (Z) (cf. mixed line centred on piston (35*p*) in FIGS. 5(*b*) and 6). In its simplest form illustrated in FIGS. 5(*a*) to 5(*c*), the manipulator (35) is coupled directly or indirectly to the lower plate (15*d*) to follow the movements thereof, and the arm (35*a*) can have a fixed length and the rotation of the arm about the central axis of the piston (35*p*) suffices to bring the ladle shroud in and out of registry with the collector nozzle (14). In FIG. 5(*a*) the manipulator is lowered and out of registry from the collector nozzle (14) in position to receive a new ladle shroud (13*a*) from the robot (21). By rotation about an axis parallel to the collector bore axis, the manipulator brings the ladle shroud in alignment with and below the collector nozzle, as shown in FIG. 5(*b*). By raising the ladle shroud as shown in FIG. 5(*c*), the manipulator couples the ladle shroud to the collector nozzle with the latter nested in the shroud bore. The ladle shroud is maintained in that position by the manipulator as long as required. As the manipulator moves together with the lower plate (15*d*) and with the collector nozzle (14) no further degrees of liberty are required in this embodiment. If the manipulator (35) is fixed to the corresponding first and second holding devices, the manipulator must have further degrees of liberty as shown in FIG. 6 to allow the ladle shroud to follow the movements of the lower plate and collector nozzle (14). Synchronization of the movements of the manipulator with the movements of the bottom plate driven by the driving device (17) is required in this case.

The removal off a spent ladle shroud proceeds in the reversed order from FIG. 5(*c*) to FIG. 5(*a*) with inverted arrows. The spent ladle shroud is decoupled from the collector nozzle by lowering it (cf. FIGS. 5(*c*) and 5(*b*)). By rotation of the manipulator the spent ladle shroud can be handed over to the robot (21) (cf. FIG. 5(*a*)).

In a preferred embodiment, however, to allow the gripping elements (35*g*) to reach any point of a plane parallel to (X, Y), the arm (35*a*) can be formed of a telescopic piston or, alternatively and as illustrated in FIG. 6, can be composed of two or more arm sections rotationally coupled to one another. The movements of the manipulator (35) are preferably driven hydraulically, pneumatically, or electrically. As shown in FIG. 6, the driving device (17) can be stored on the first and second holding devices, preferably on a static portion of the corresponding manipulator, sharing with the manipulator a source of hydraulic or pneumatic fluid, or electrical current.

As mentioned supra, the manipulator can be fixed to the first and second holding devices of the transportation device (or to a portion of the corresponding manipulators which is static relative to the holding devices) as illustrated in FIGS. 1 and 3. This solution is advantageous in that the manipulator remains coupled to the transportation device even when a new ladle (12*b*) is loaded onto a holding device or an emptied ladle is carried away from the holding device.

Alternatively, the manipulator can be fixed to the ladle sliding gate (15), preferably moving together with the lower plate (15*d*), as illustrated in FIGS. 2(*a*) to 2(*d*), 3(*a*) to 3(*d*), and 5(*a*) to 5(*c*). This solution has the advantage that the manipulator needs not be synchronized with the driving device (17) to ensure that the ladle shroud held by the manipulator follows the same movements as the collector nozzle (14), which movements are controlled by the driving device (17). On the other hand, the manipulator must be fixed anew to the ladle sliding gate (15) each time a new ladle (12*b*) is loaded onto a holding device, and must be removed each time an empty ladle is removed from the transportation device.

Method for Casting Molten Metal

The present invention also concerns a method for casting molten metal (2) from a ladle (11, 12) into a tundish (1) in a casting installation as discussed supra, with the first ladle (11) being full of molten metal and being located at the casting station and the second ladle (12) being full of molten metal and being at the loading station. As illustrated in FIG. 1(*a*), the ladle sliding gate (15) of the first ladle (11) is in the sealed position and is provided with a ladle shroud (13*a*-13*c*) held in place over a collector nozzle (14) by a manipulator (35). The lower plate (15*d*) of the ladle sliding gate is coupled to a driving device (17). The ladle sliding gate (15) of the second ladle (12) is in the sealed position and comprises a collector nozzle (14) but no ladle shroud. The ladle sliding gate (15) of the second ladle (12) is not coupled to any driving device (17).

In order to start casting molten metal from the first ladle (11) through the ladle shroud (13*a*) into the tundish (2), the ladle sliding gate (15) of the first ladle (11) is brought into casting position. This operation is performed by actuating the driving device (17). The first ladle (11) discharges the molten metal (2) contained therein into the tundish (1) until the first ladle is considered emptied.

As the first ladle (11) is discharging its content into the tundish, the robot (21) handles a new ladle shroud (13*b*) to the manipulator (35) fixed to the second holding device (cf. FIG. 1(*b*)) As illustrated in FIG. 1(*c*), on the one hand, the manipulator (35) couples the thus received ladle shroud onto the ladle sliding gate (15) of the second ladle (12) and, on the other hand, the robot (21) couples the driving device (17) to the sliding plate gate (15) of the second ladle (12). As discussed supra, the latter operation is made simpler if the first and second holding devices of the turret (30) are provided with a storing unit for storing one or more driving devices (17), because the one or more devices can thus remain coupled to the source (17*h*) of pressurized fluid via the hose (17*t*) during a whole casting operation involving emptying several (more than two) ladles into the tundish. If the one or more driving devices (17) are stored elsewhere, typically in the storage rack (29) located on the loading platform (20), the robot (21) must additionally couple one or more hoses (17*t*) to corresponding one or more driving devices to render them operational. During the whole operation on the second ladle (12) the ladle sliding gate remains in the sealed position.

As shown in FIG. 1(*d*), when the first ladle is substantially empty, the ladle sliding gate (15) of the first ladle (11) is brought from the casting position into the sealed position to interrupt any flow of molten metal out of the first ladle (11). The positions of the first and second ladles are swapped by moving the first ladle (11) from the casting station to the loading station and, concomitantly, moving the second ladle (12) from the loading station to the casting station. The positions swapping of the first and second ladles (11, 12) can be performed as follows. FIG. 1(*d*) illustrates how the turret (30) can lift the first and second ladles (11, 12) until the ladle shrouds (13*a*, 13*b*) of the first and second ladles are both clear off and higher than the tundish in a vertical direction (Z), defining a rotating altitude. The turret can thus rotate without any risk of a ladle shroud (13*a*, 13*b*) of the first or second ladle (11, 12) colliding with the tundish or with any other component of the casting installation. FIG. 1(*e*) illustrates the rotation of the turret about the vertical axis (Z) by 180° to bring the emptied first ladle (11) above the loading station, and to bring the filled second ladle (12) above the casting station and above the tundish (2). During the rotation operation, the first and second ladles are constantly maintained at their rotating altitude. At this stage, the first and second ladles (11, 12) can be lowered to their respective loading and casting stations, the ladle shroud (13*b*) of the second ladle being inserted into the tundish (2).

The ladle sliding gate (15) of the second ladle (12) can be brought into casting position such that molten metal can flow from the second ladle (12) through the ladle shroud (13*b*) into the tundish (2). The whole swapping operation from closing the ladle sliding gate of the first ladle (11) to opening the ladle sliding gate of the second ladle (12) can last less than 2 min, preferably less than 1 min more preferably less than 30 s, and the level of molten metal in the tundish can easily be restored to a stationary casting level.

If the manipulator (35) is fixed to a corresponding holding device of the transportation device, it must be configured for following synchronously the movements of the lower plate (15*d*) of the ladle sliding gate (15), such that the collector nozzle (14) and ladle shroud (13*a*-13*c*) are constantly nested in one another. If the manipulator (35) is fixed to the lower plate (15*d*) or any element of the ladle sliding gate which is static relative to the lower plate (15*d*), then it is not necessary to synchronize the movements of the manipulator (35)

with those of the driving device (17) since the manipulator moves together with the lower plate (15*d*).

The emptied first ladle (11) parked at the loading station can now be stripped of the ladle shroud to allow the removal and transportation thereof across the workshop to a refurbishing station (not shown). The manipulator (35) de-couples the spent ladle shroud from the collector nozzle (14) by lowering it along the central axis of the collector bore, and hands the spent ladle shroud to the robot (21). The spent ladle shroud (13*a*) can be stored for refurbishing and cleaning (not shown) or can be disposed of as waste in a disposal bin (27) as shown in FIG. 1(*f*).

As illustrated in FIG. 1(*f*), the robot (21) can decouple and remove the one or more driving devices (17) from the sliding plate gate (15) of the first ladle (11) and storing them for further use. If the first and second holding devices of the turret (30) are provided with a storing unit for storing one or more driving devices (17), then the robot (21) needs not disconnect the corresponding one or more hoses (17 *t*) prior to storing them, since the source (17 *h*) of hydraulic or pneumatic fluid or the source of electric power is also located at the first and second holding devices. If, on the other hand, the one or more driving devices (17) are to be stored in the storage rack (29) located on the loading platform (20), then the robot must also disconnect the one or more hoses (17 *t*) from the corresponding one or more driving devices (17) prior to storing them in the storage rack (29). The same applies if a driving device must be changed because it is defective.

The emptied first ladle, stripped of the ladle shroud (13*a*) and of the one or more driving devices (17) can be removed from the first holding device by a crane to a refurbishing station (not shown), where the ladle can be cleaned, repaired, and made ready for being filled with a new load of molten metal from a furnace. A new ladle full of molten metal can be loaded onto the now empty first holding device of the ladle turret (30) at the loading station wherein, like the second ladle (12) in step (a), the new ladle comprises a ladle sliding gate (15) in the sealed position and comprising a collector nozzle no ladle shroud (13*a*-13*c*) and no driving device (17). The cycle depicted in FIGS. 1(*a*) to 1(*f*) can thus be repeated, and casting from the tundish to a tool can proceed continuously, with the level of molten metal in the tundish being substantially constant throughout the continuous casting operation, with little fluctuations when swapping the positions of the emptied ladle (11) and a filled ladle (12) defined in step (e). Said fluctuations can be very small since, when functioning optimally, the swapping operation is very swift.

In case step (e) of swapping positions of the first and second ladles does not proceed optimally, because the inner and/or upper bores are clogged with solidified plugging material, the inner and/or upper bores can rapidly and efficiently be un-clogged by using an appropriate unclogging tool (19*r*) through the collector bore, as described supra in reference with FIGS. 2(*a*)-(*d*), 3(*a*)-(*d*), and 4(*a*)-(*c*) in the section entitled "LADLE SLIDING GATE (15)." This way, the interruption of metal flow into the tundish is reduced to a minimum. Absent these options for rapid un-clogging of the casting channel, many operators would be reluctant to couple a ladle shroud (13*a*-13*c*) to a bottom of a ladle at the loading station, with or without a robot (21), because un-clogging the inner and upper bores with a ladle shroud coupled to the ladle sliding gate would require returning the clogged ladle to the loading station and replacing the ladle shroud by a collector nozzle to allow un-clogging with an unclogging tool (19*r*), then coupling again the ladle shroud and bringing the ladle back to the casting station. All these operations would take too long, with a risk of metal freezing, which was to be prevented by the use of a plugging material. Furthermore, a long period without feeding the tundish with molten metal could provoke the interruption of the casting operation, which must be avoided by all means.

In a preferred embodiment, the loading operations of a second ladle (12) stationed at the loading station are carried out in the following order: (1) coupling of the driving device(s) to the ladle sliding gate (15), followed by the handling of a new ladle shroud (13*b*) to the manipulator (35) and coupling of the new ladle shroud over the collector nozzle (14). The unloading operations of an emptied first ladle (11) stationed at the loading station are preferably carried out in the following order: (1) uncoupling of the spent ladle shroud (13*b*) by the manipulator (35), handling of the spent ladle shroud to the robot (21), followed by uncoupling of the driving device(s) from the ladle sliding gate (15).

Advantages of the Present Invention

The present invention offers an automated metal casting installation, wherein a fresh ladle can be made ready for casting by a robot (21) at the loading station, without any additional risk of casting disruption into the tool compared with conventional metal casting installations. The present invention has at least the following advantages.

- A robot is no longer essential on the casting platform of the casting station. Many installations do not have the required space at the casting station. With the present invention, a robot is installed at the loading station, where there is more room available for installing a robot on the loading platform (20), to hand over a ladle shroud (13*a*-13*c*) to a manipulator (35) for coupling to a newly filled ladle (12) at the loading station, before the newly filled ladle reaches the casting station. A front-end manipulator is generally available at the casting station of many casting installations. This front-end manipulator can still be useful, e.g., to handle an unclogging tool (19*r*) in case the inner bore and/or upper bore become clogged, whilst the manipulator (35) disengages the ladle shroud from the collector nozzle as explained supra.
- The present invention strongly reduces steel off time between ladles changes, as all handling and preparation of a newly filled ladle (12) for casting are carried out at the loading station, during casting time of a first ladle (11) held at the casting station. Shorter ladle steel off times,
  - yield lower steel level drops in the tundish (1),
  - yield better steel quality protection, as there is no need to reduce casting speed during ladle change.
- In case of clogging of the inner and/or upper bores, the unclogging operation can be carried out similarly as when the ladle shroud is maintained in position with a robot or a front-end manipulator in existing metal casting installations, with the further advantage that, is a robot or front-end manipulator is available at the casting station, this is free for any use while the manipulator (35) holds the ladle shroud (13*a*-13*c*).

| REF | DESCRIPTION |
|---|---|
| 1 | Tundish |
| 2 | Molten metal |

-continued

| REF | DESCRIPTION |
|---|---|
| 3 | Casting tool |
| 5 | Tundish sliding gate |
| 11 | First ladle |
| 11o | Opening of first ladle |
| 12 | Second ladle |
| 12b | New ladle |
| 12o | Opening of second ladle |
| 13a-13c | Collector nozzle |
| 14 | Lade shroud |
| 15 | Ladle sliding gate |
| 15d | Lower plate of ladle sliding gate |
| 15u | Upper plate of ladle sliding gate |
| 15w | Drawer |
| 17 | Driving device |
| 17c | Cylinder |
| 17h | Source of hydraulic/pneumatic fluid |
| 17p | Piston |
| 17t | Hose |
| 17w | Drawer driving device |
| 18 | Inner nozzle |
| 19 | Plugging material |
| 19r | Unplug rod |
| 20 | Loading platform |
| 21 | Robot |
| 25 | Pre-heating oven |
| 27 | Disposal bin |
| 29 | Storage rack |
| 30 | Ladle turret |
| 31 | Robot at casting station |
| 35 | Ladle shroud manipulator |
| 35a | Arm of the manipulator |
| 35g | Gripping elements of the manipulator |
| 35p | Piston parallel to Z of the manipulator |

The invention claimed is:

1. A metal casting installation comprising, (a) a loading platform (20);

(b) a tundish (1);

(c) a first ladle (11) and a second ladle (12), each of the first and the second ladle comprising, a floor provided with an opening (110, 120), a ladle shroud (13*a*-13*c*), and a ladle sliding gate (15) comprising a collector nozzle (14) configured for reversibly receiving and supporting the ladle shroud, the ladle sliding gate (15) being further configured for being coupled to a driving device (17) for actuating the ladle sliding gate between a sealed position wherein the opening is sealed and a casting position wherein the opening is in fluid communication with the ladle shroud (13*a*-13*c*);

(d) a set of first and second ladle shroud manipulators (35) for holding the ladle shroud (13*a*-13*c*) coupled over the collector nozzle (14) of the first and second ladles, respectively, each of the first and second ladle shroud manipulators are fixed relative to the corresponding first or second ladle (11, 12), in order to move together in unison with the corresponding first or second ladle between a loading station and a casting station;

(e) a transportation device including a turret (30) or a ladle car, the transportation device further comprising at least a first holding device and a second holding device for holding the first ladle (11) and the second ladle (12), respectively, wherein the transportation device is configured for moving and holding in place the first and second ladles (11,12) between the loading station, adjacent to the loading platform (20), and the casting station, over the tundish (1); and (f) a robot (21) configured for carrying out the following operations on the first or second ladle (11, 12) when located in the loading station, handing a new ladle shroud (13*b*) to the manipulator (35) of the ladle located at the loading station, and coupling a driving device (17) to the ladle slide gate (15).

2. The metal casting installation according to claim 1, wherein the loading platform (20) comprises a tool storage rack (29) containing one or more spare ladle shrouds (13*b*, 13*c*) within reaching distance of the robot (21).

3. The metal casting installation according to claim 2, wherein the robot (21) is movingly mounted on the loading platform (20) such that the robot can translate parallel to a first axis (X) and/or second axis (Y) normal to the first axis (X), or combination thereof, and/or rotate about a vertical axis (Z) normal to the first and second axes (X, Y), in order to reach and retrieve any tool or component from the storage rack (29) and to reach the ladle sliding gate of the first or second ladle (11, 12) which is held at the loading station.

4. The metal casting installation according to claim 1, wherein the robot (21) is configured for collecting from the manipulator (35) of the emptied first or second ladle (11, 12) which is held at the loading station after being moved from the casting station, the ladle shroud (13*a*-13*c*) and for removing the driving device (17).

5. The metal casting installation according to claim 1, wherein the ladle sliding gate (15) comprises, (a) an upper plate (15*u*) comprising, a fixing surface and a bottom sliding surface separated from one another by a thickness of the upper plate, an upper bore extending from the fixing surface to the bottom sliding surface, and wherein the fixing surface of the upper plate is rigidly fixed to a lower portion of the corresponding first or second ladle (11, 12) with the upper bore in fluid communication with the opening;

(b) a lower plate (15*d*) comprising, a nozzle surface and a top sliding surface separated from one another by a thickness of the lower plate, a lower bore extending from the top sliding surface to the nozzle surface, wherein the lower plate (15*d*) being slidingly mounted such that the top sliding extending from the top sliding surface to the nozzle surface, surface can slide in translation along the bottom sliding surface to bring the lower bore in and out of fluid communication with the upper bore; and wherein (c) the collector nozzle (14) comprising a collector bore and being fixed to the nozzle surface of the lower plate (15*d*) with the collector nozzle in fluid communication with the lower bore; and (d) the driving device (17) being coupled to the lower plate (15*d*) and comprising a cylinder (17*c*) rigidly and reversibly coupled to the bottom portion of the corresponding first or second ladle (11, 12), and a piston (17*p*) rigidly and reversibly fixed to the lower plate (15*d*), the driving device being configured for moving the lower plate to bring the lower bore in and out of registry with the upper bore.

6. The metal casting installation according to claim 5, wherein the lower plate (15*d*) further comprises a second lower bore separate from the lower bore and extending from the top sliding surface to the nozzle surface, and a second collector nozzle (14) comprising a second collector bore is fixed to the nozzle surface of the lower plate (15*d*) with the second collector bore in fluid communication with the second lower bore.

7. The metal casting installation according to claim 1, wherein each of the first and second manipulator (35) is fixed either, to the corresponding first and second holding devices, or to the ladle sliding gate (15) of the corresponding first and second ladle, such as to move together with the lower plate, or to the corresponding first and second ladles (11, 12).

8. The metal casting installation according to claim 1, wherein each of the first and second manipulators (35), can translate along a first direction parallel to an upper bore, can rotate about the first direction, and comprises one or more arm segments extending substantially normal to a column parallel to the first direction, the one or more arm segments being coupled to the column and to one another by rotating joints configured for rotating about the first direction, comprises gripping elements (35*g*) at a free end of the arm segment most remote from the column, for firmly and reversibly holding ladle shroud (13*a*-13*c*).

9. The metal casting installation according to claim 1, wherein, the driving device (17) is actuated hydraulically or pneumatically or electrically, and wherein each of the at least first holding device and second holding device of the transportation device is provided with, a source of pressurized fluid for activating the driving device (17) via a hose (17*t*), or a source of electric power.

10. The metal casting installation according to claim 1, comprising a pre-heating oven (25) for bringing and maintaining at a pre-heating temperature the new ladle shroud (13*b*) loaded on the ladle sliding gate (15) of the first or second ladle (12) located at the loading station.

11. The metal casting installation according to claim 1, wherein the robot is also configured, for checking a state of a spent ladle shroud (13*a*-13*c*) after removal from an emptied ladle, for assessing whether the spent ladle shroud can be re-used after cleaning or whether it must be disposed of, and for cleaning the spent ladle shroud, with an oxygen shower, to remove any residue clinging to walls of the spent ladle shroud.

12. The metal casting installation according to claim 2, further comprising tools and/or one or more driving devices (17) and/or spare collector nozzles (14) within reaching distance of the robot (21).

13. The metal casting installation according to claim 9, further comprising a storing station for storing the driving device (17) ready for coupling to a ladle sliding gate.

* * * * *